US007942516B2

(12) United States Patent
Ohara et al.

(10) Patent No.: US 7,942,516 B2
(45) Date of Patent: May 17, 2011

(54) IMAGE FORMING METHOD AND IMAGE FORMING APPARATUS

(75) Inventors: Midori Ohara, Tokyo (JP); Hiroshi Taniuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/619,231

(22) Filed: Nov. 16, 2009

(65) Prior Publication Data

US 2010/0060703 A1 Mar. 11, 2010

Related U.S. Application Data

(63) Continuation of application No. PCT/JP2009/060202, filed on Jun. 3, 2009.

(30) Foreign Application Priority Data

Jun. 3, 2008 (JP) ..... 2008-145754

(51) Int. Cl.
*B41J 2/01* (2006.01)

(52) U.S. Cl. ..... 347/102; 347/103

(58) Field of Classification Search ..... None
See application file for complete search history.

(56) References Cited

U.S. PATENT DOCUMENTS

| | | | | |
|---|---|---|---|---|
| 6,517,177 | B2 * | 2/2003 | Moto et al. | 347/14 |
| 2006/0250467 | A1 * | 11/2006 | Folkins | 347/103 |

FOREIGN PATENT DOCUMENTS

| | | | |
|---|---|---|---|
| JP | 03-284948 | | 12/1991 |
| JP | 06-182982 | | 7/1994 |
| JP | 06-218913 | | 8/1994 |
| JP | 07-047760 | | 2/1995 |
| JP | 07047760 | A * | 2/1995 |

OTHER PUBLICATIONS

International Search Report in PCT/JP2009/060202, mailed Jun. 30, 2009.

* cited by examiner

*Primary Examiner* — Stephen D Meier
*Assistant Examiner* — Alexander C Witkowski
(74) *Attorney, Agent, or Firm* — Fitzpatrick, Cella, Harper & Scinto

(57) ABSTRACT

Provided are an image forming method and image forming apparatus capable of always stably transferring an ink image on an intermediate transfer body to a printing medium and stably obtaining an image with high quality. Formation and drying operation of the image using an inkjet method are repeated a plurality of times to obtain the image on the intermediate transfer body and the thus obtained image is transferred from the intermediate transfer body to a printing medium to form the image. At this time, a capability of the drying operation finally performed among a plurality of times of the drying operations is more lowered than those of all the drying operations except the drying operation finally performed.

7 Claims, 10 Drawing Sheets

IMAGE FORMING METHOD AND IMAGE FORMING APPARATUS

BACKGROUND OF THE INVENTION

1. Field of the Invention

The present invention relates to an inkjet image forming method and an inkjet image forming apparatus. Specifically, the present invention relates to an image forming method and an image forming apparatus that form an ink image on an intermediate transfer body by using a inkjet method and transfer the ink image to a printing medium for performing printing.

2. Description of the Related Art

Recently, there is growing a request for taking advantage of an inkjet printing method and outputting an image with high quality using an inkjet printing method regardless of types of a printing medium. For example, there is a request for performing printing onto a printing medium that does not absorb any aqueous ink composition, such as plastics or metal (hereinafter, also referred to as "non-ink-absorbency"). Also, there is a request for performing printing onto a printing medium in which the amount of absorbing aqueous ink compositions is small or the absorption speed for absorbing aqueous ink compositions is slow (hereinafter, also referred to as "low ink absorbency"), such as art paper or coated paper among printing papers. It is desired that when performing printing onto the above-described printing media, for the purpose of improving quality of images, a factor that contributes to reduction in image quality on the printing medium or reduction in texture of printed matters is suppressed. Specifically, phenomena called feathering, beading, and bleeding as well as a waving phenomenon (cockling) of the printing medium caused by permeation of water-based ink into the printing medium are required to be suppressed. Higher precision and speeding up of the inkjet printing method are contributory to some of the above-described phenomena. The phenomena must be more effectively suppressed under the following conditions: a large amount of ink is applied in a high speed per unit area of the printing medium, and further, various materials are being used as the printing media.

To cope with the above-described problem, there is a printing method in which ink is applied to an intermediate transfer body to form an ink image by the inkjet printing method and such ink image is transferred to a printing medium (see Japanese Patent Laid-Open No. H06-182982 (1994), Japanese Patent Laid-Open No. H06-218913 (1994)). This transfer method is such that the ink image is formed on the intermediate transfer body once, the ink image is dried and thereafter the intermediate transfer body is pressed onto the printing medium to transfer the ink image to the printing medium.

According to the printing method using this transfer method, since a phenomenon such as feathering, beading, or bleeding is suppressed, types of applicable printing media can be increased. Further, before formation of the ink image, a processing liquid that causes thickening of ink or aggregation and/or insolubilization of colorant by reacting with the ink is applied to the intermediate transfer body in some cases. As a result, the ink applied to the intermediate transfer body instantly agglomerates to be insolubilized before causing the image degradation such as bleeding, thereby also fixing the ink image with preferable image quality without change.

Further, the use of the intermediate transfer body in the inkjet printing method has the benefit that dusts such as paper powder generated from the printing medium hardly become attached to nozzles. More specifically, since a print head having the nozzles for ejecting ink is disposed at a position distant from the printing medium, clogging caused by the attachment of the paper powder to the nozzles can be suppressed.

Further, the ink image formed on the intermediate transfer body, before the transfer operation to the printing medium, goes through the drying step as a step of removing an extra liquid component contained in the ink image, thereby reducing the liquid volume permeated into the printing medium. Therefore, there is the advantage of hardly causing cockling and that of doing no harm to a texture of the printing medium such as rigidity and touch.

However, in the transfer method, when the level of dryness of the ink image on the intermediate transfer body during the transfer operation is not proper, the ink image cannot be transferred while keeping quality of the image on the intermediate transfer body, and accordingly, the quality of the image formed on the printing medium may be reduced. Specifically, when a drying operation is insufficient, the distortion of the image (hereinafter, also referred to as "image flowing") or the bleeding readily occurs. On the other hand, when the ink image is overdried, tackiness between the ink image and the printing medium is reduced, and the tackiness between the ink image and the intermediate transfer body surface is relatively strengthened. As a result, a phenomenon in which the ink image is broken into the intermediate transfer body and the printing medium (hereinafter, also referred to as "separation"), and accordingly the ink may remain on the intermediate transfer body also after the transfer operation (hereinafter, also referred to as "transfer residue"). The above-described separation and transfer residue tend to be prominently caused with the progress of drying. Further, also when the drying operation is insufficient depending on types or concentration of the ink, a cohesive force within the ink image is insufficient in a residual solvent, and as a result, the separation may occur.

As described above, in the transfer method, if the transferring the ink image is performed with a dried condition remaining insufficient or over, the degradation of image quality due to drying failure easily occurs. To prevent the degradation of image quality from occurring, the transferring the ink image must be performed in a condition that a residual liquid amount in the ink image on the intermediate transfer body is in an adequate range. FIG. 1 is a diagram showing an adequate range ($b \leqq W \leqq a$) of the residual liquid amount within the ink image on the intermediate transfer body. The vertical axis represents the residual liquid amount W within the ink image and the horizontal axis represents the drying time t. The residual liquid amount W decreases so as to tilt downward in the right with the drying time getting longer. When the residual liquid amount is larger than an upper limit "a" of the adequate range, the image flowing is caused by the shortage of drying. Meanwhile, when the residual liquid amount is smaller than a lower limit "b" of the adequate range, the transfer residue is caused by the over drying. Therefore, the residual liquid amount W during the transfer needs to be within the adequate range. Accordingly, the drying time t must fall within a range of $t(a) \leqq T \leqq t(b)$. Here, "t(a)" is a time at which the residual liquid amount W becomes the upper limit "a" and "t(b)" is a time at which the residual liquid amount W becomes the lower limit "b".

To prevent the degradation of image quality due to the transfer in the insufficient drying or an over drying state from occurring, Japanese Patent Laid-Open No. H07-047760 (1995) discloses a method that repeats a cycle of inkjet image formation, drying and transferring plural time to form an image on one piece of the printing medium.

However, in the method disclosed in Japanese Patent Laid-Open No. H07-47760 (1995), the drying operation of the same powers and the same operation time is performed in all of the plural time of drying operation. As a result, securing stability of the transfer and securing high throughput can not go together.

More specifically, for securing the transfer stability, it is desirable to perform each of the plural time of drying operation with low drying powers and long time (T1). Thus, even if a drying state changes due to change in a surrounding environment (temperature, humidity or the like) of an apparatus (that is, even if the drying state shown by a solid line in FIG. 3A changes into a condition shown by any one of two dotted lines), only performing the drying operation of the predetermined drying time (T1) allows the residual liquid amount at the transfer to be readily within the adequate range. In other wards, even if the drying states changes into the condition shown by any one of the dotted lines, a slope of drying curve designated by the dotted line is small so that a deviated amount by which the residual liquid amount at the time T1 deviates from a predetermined residual liquid amount within the adequate range is small. As a result, the residual liquid amount at the transfer readily has an amount within the adequate range, even if the drying state changes. Accordingly, the transferring an ink image can be performed in the condition in which the residual liquid amount is within the adequate range and therefore transferring failure due to the shortage of drying or the over drying hardly occurs. However, in this case, as apparent from FIG. 3A, total drying time becomes long as T1×3 and thus high throughput can not be realized.

On the other hand, when the drying operation with high powers and shirt drying time as shown in FIG. 3B, high throughput can be realized. However, in this case, if the drying state changes as shown by dotted line in FIG. 3B due to the change in the surrounding environment (temperature, humidity or the like), the residual liquid amount during the transferring is readily outside the adequate range of residual liquid amount though the drying operation is performed for a predetermined drying time (T2). More specifically, contrary to the case shown in FIG. 3A, a deviated amount by which the residual liquid amount at the time T2 deviates from a predetermined residual liquid amount within the adequate range is relatively large. As a result, the residual liquid amount at the transferring readily has an amount outside the adequate range. Accordingly, the transfer failure due to the shortage of drying or over drying readily occurs and thus the transfer stability can not be secured.

SUMMARY OF THE INVENTION

As described above, the prior art methods can not achieve a balance between the transfer stability and the high throughput. The present invention is made by taking into consideration the above problem and the object of the present invention is an achievement of the balance between the transfer stability and the high throughput.

In a first aspect of the present invention, there is provided a method for forming an image, comprising the steps of: repeating a process a plurality of times, the process including an image forming step for forming an image on an intermediate transfer body by ejecting ink from an inkjet head onto the intermediate transfer body and a drying step for drying the image on the intermediate transfer body after the image forming step; and transferring the image, which is obtained through the plurality of times of processes, from the intermediate transfer body to a printing medium, wherein a drying power and drying time in the drying step included in a final process, of the plurality of times of drying steps included in the plurality of times of process, are the lowest and the longest respectively.

In a second aspect of the present invention, there is provided an image forming apparatus comprising: an image forming unit configured to form an image on a intermediate transfer body by ejecting ink onto the intermediate transfer body from an inkjet head; a drying configured to perform a drying treatment for drying the image formed on the intermediate transfer body; a controller configured to control said image forming unit and said drying unit so that a process in which the drying treatment is performed by said drying unit after the image is formed by said image forming unit is performed a plurality of times; and a transferring portion for transferring the image, which is obtained through the plurality of times of processes, from the intermediate transfer body to a printing medium, wherein a drying power and drying time in the drying treatment included in a final process, of the plurality of times of drying treatments included in the plurality of times of process, are the lowest and the longest respectively.

In a third aspect of the present invention, there is provided an image forming apparatus comprising: a plurality of sections each of which includes an image forming unit configured to form an image on a intermediate transfer body by ejecting ink onto the intermediate transfer body from an inkjet head, and a drying unit configured to dry the image formed on the intermediate transfer body; a transferring portion for transferring the image, which is obtained through the plurality of times of image forming and plurality of times of drying by said plurality of sections, from the intermediate transfer body to a printing medium, wherein a drying power and drying time by the drying unit which performs final drying, of the plurality of drying units included in said plurality of sections, are the lowest and the longest respectively.

It should be noted that the "drying powers" means an amount of a component removed per unit of time, which is one of components contained in the ink and is most vaporizable, and is expressed Y (g/sec). The smaller the value of Y (g/sec), the lower the drying power is.

According to the above-described configuration, in the last drying step that most affects the transfer stability, the drying operation with low drying power (weak drying power) and long drying time is performed on giving a priority to the transfer stability. On the other hand, in the drying steps other than the last step that less affect the transfer stability, the drying operation with high drying power (strong drying power) and short drying time is performed on giving a priority to the high throughput. As a result, the balance between the transfer stability and the high throughput can be achieved.

Further features of the present invention will become apparent from the following description of exemplary embodiments (with reference to the attached drawings).

DESCRIPTION OF THE EMBODIMENTS

Hereinafter, embodiments according to the present invention will be described in detail with reference to the accompanying drawings.

First Embodiment

Figure 2:
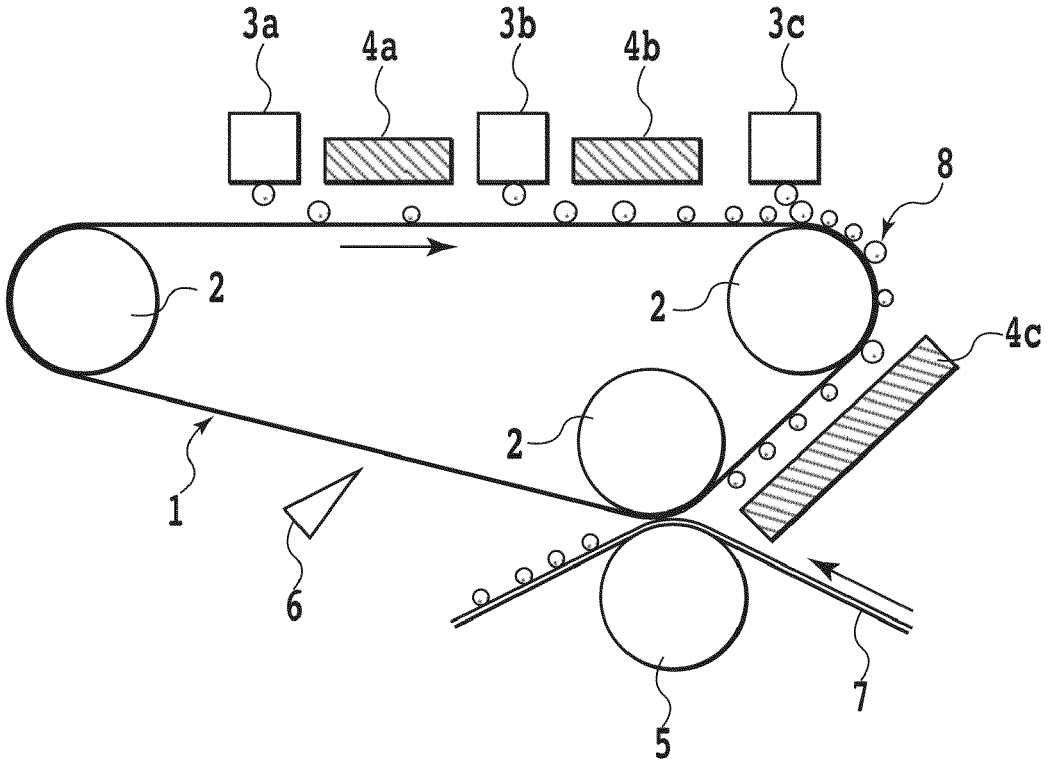
FIG. 2 is a schematic view illustrating an image printing apparatus according to a first embodiment of the present invention.

FIG. 2 is a schematic view illustrating an intermediate transfer body and configuration of its periphery of an image printing apparatus according to the present embodiment. The intermediate transfer body 1 is made up of an endless belt that is stretched around transfer body rotation rollers 2 and rotates in the direction of an arrow. Each of image forming portions 3*a*, 3*b* and 3*c* has an ink ejection head for ejecting ink by using an inkjet method and a reaction ejection head for ejecting a reaction liquid, which reacts on ink, by using the inkjet method. These ink and reaction liquid ejection heads respectively include ejection openings arranged across a width of the intermediate transfer body 1 that moves around and thus are called a full-line head. The image forming portions 3*a*, 3*b* and 3*c* respectively eject the ink and reaction liquid onto the intermediate transfer body and form an image on a surface layer of the intermediate transfer body 1. Drying portions 4*a*, 4*b*, and 4*c* dry the image at every completion of the image formation by each of these image forming portions 3*a*, 3*b*, and 3*c*. As apparent from FIG. 2, the drying portion 4*a* is provided between the image forming portions 3*a* and 3*b*, and dries the image formed by the image forming portion 3*a*. The drying portion 4*b* is provided between the image forming portions 3*b* and 3*c*, and dries the image formed by the image forming portions 3*a* and 3*b*. The drying portion 4*c* is provided between the image forming portion 3*c* and a transfer portion, and dries the image formed by the image forming portions 3*a*, 3*b* and 3*c*. Hereinafter, a section including the image forming portion 3*a* and the drying portion 4*a* is called a first section, a section including the image forming portion 3*b* and the drying portion 4*b* is called a second section, and a section including the image forming portion 3*c* and the drying portion 4*c* is called a third section.

The image formed on the surface layer of the intermediate transfer body 1 are transferred to a printing medium 7 from the intermediate transfer body 1 in the transfer portion corresponding to a nip between the intermediate transfer body 1 and a pressure roller 5. Thereby, the image is formed on the printing medium 7. The intermediate transfer body 1 after transferring the ink image to the printing medium, is cleaned (for example, washing) by a cleaning unit 6 for preparing the next image formation.

Figure 5:
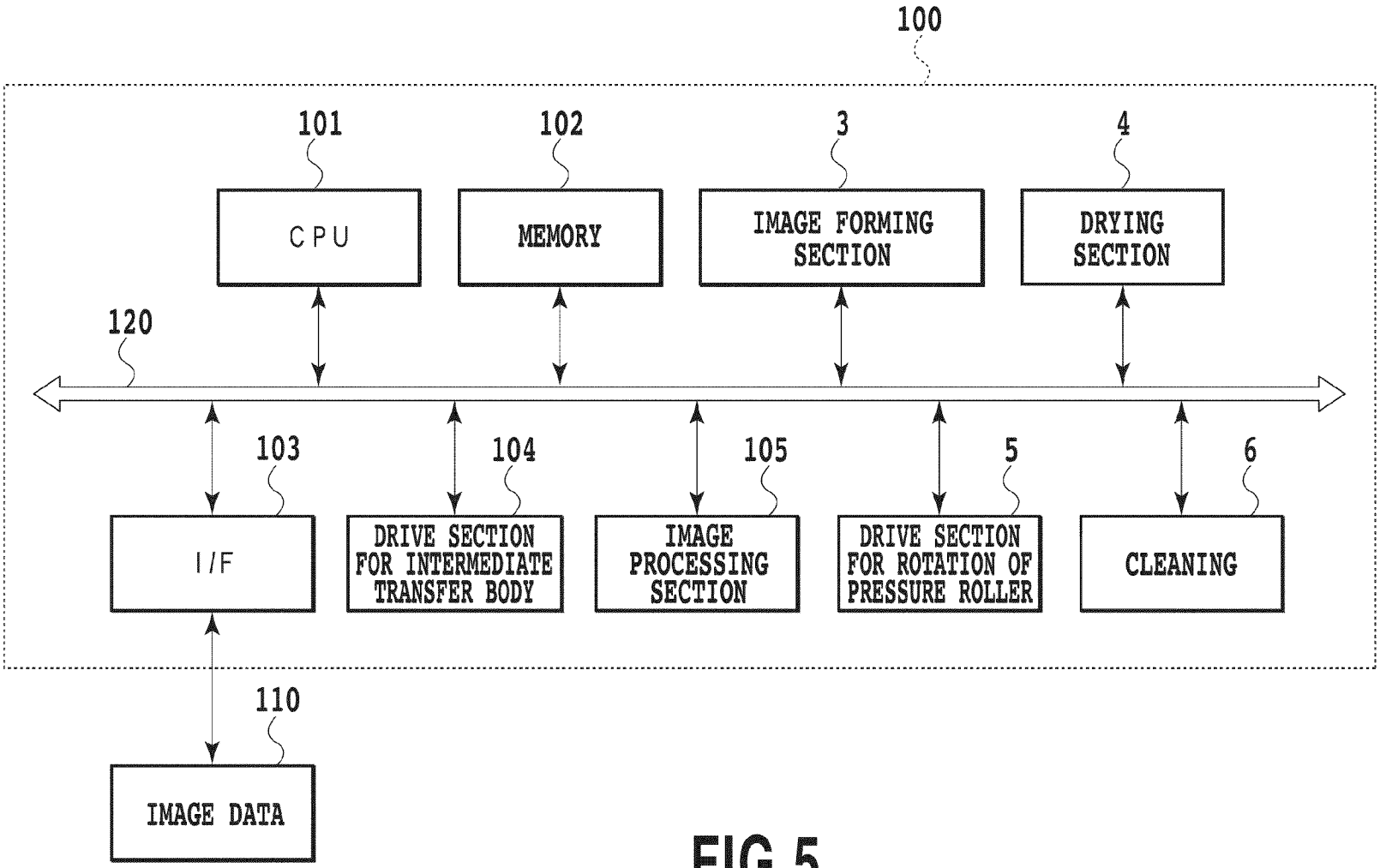
FIG. 5 is a block diagram showing a control system for the image printing apparatus according to the first embodiment of the present invention.

FIG. 5 is a block diagram showing an outline of a control system of the image printing apparatus according to the present embodiment. In the image printing apparatus 100, a CPU 101 acts as a main controller of the whole system and controls each section by transmitting control signals to each section. A memory 102 is made of a ROM storing a basic program for the CPU 101, a RAM that is used for temporary storage of various types of data and is used as a work area, and the like. An interface 103 transmits and receives information such as data and commands to and from an image data supply apparatus 110 as a source of image data which may take a form of a host computer or others. An intermediate transfer body drive section 104 drives a motor for rotating the transfer body rotation rollers 2 to rotate the transfer body rotation rollers 2, and thus rotates the intermediate transfer body. A pressure roller rotation drive section 106 drives a motor for rotating the pressure roller 5 to rotate the pressure roller 5. An image processing section 105 performs a process for generating ink ejection data and reaction liquid ejection data to be supplied to each of the image forming portions (3*a*, 3*b* and 3*c*), based on image data transmitted from the image data supply apparatus 110. A bus line 120 interconnects the image forming portions 3 (3*a*, 3*b* and 3*c*), the drying portions 4 (4*a*, 4*b*, 4*c*), and the cleaning unit 6 in addition to each of the above-described sections, and transmits control signals of the CPU 101. On each section to be controlled, a status detecting sensor is provided so that detected signals can be transmitted to the CPU 101 via the bus line 120.

Referring back to FIG. 2 and FIG. 4, an image forming step according to the present embodiment will be described in detail. Following description is made for a case using a computer in which application software and a printer driver for the image printing apparatus are installed, as the image data supply apparatus. The printer driver in the image data supply apparatus 110 converts image data generated by the application software and the like into image date (RGB data) which the image printing apparatus 100 can treat, in response to a command to start printing. Then, the image data (RGB data) as well as the command data to start printing is transmitted to the image printing apparatus 100.

The image printing apparatus 100 receives the image data (RGB data) and the command to start printing transmitted from the image data supply apparatus 110. The memory 102 in the printing apparatus 1000 has a capacity for store several pages of image data and contemporarily stores one page of image data (RGB data). When the image printing apparatus 100 receives the print start command, the CPU 101 outputs a drive command to the intermediate transfer body drive section 104. As a result, the transfer body rotation rollers 2 rotate and thus the intermediate transfer body 1 rotates. Also, when the image printing apparatus 100 receives the image data (RGB data), the image processing section 105, under a control of the CPU 101, generates ink ejection data and reaction liquid ejection data supplied to each of the image forming portions 3*a*, 3*b* and 3*c*.

Data generation processing executed by the image processing section 105 will be explained below. The image processing section 105 performs a color conversion process that converts one page of image data (RGB data) stored in the memory 102 into CMYK multi-valued data for each pixel. Then, the image processing section 105 performs a binarization process that converts the CMYK multi-valued data into CMYK binary data to generate the CMYK binary data. Thereafter, the image processing section 105 inverts the CMYK binary data to generate CMYK binary data of a mirrored image. Thus, the image data of binary (CMYK binary data) corresponding to one page of image to be printed on the intermediate transfer body is generated. Then, the image processing section 105 divides the image data of binary (CMYK binary data) corresponding to one page of image into three image data to generate first, second and third divided image data (first, second and third CMYK binary data). More specifically, one page of image data is thinned out by two columns of image data every one column and thus divided into n-th column data group (first divided image data), n+1-th column data group (second divided image data) and n+2-th column data group (third divided image data). Here, the column means pixel arrays arranged along a moving direction of the intermediate transfer body 1. It should be noted that a data dividing method is not limited to the above column thinning method. For example, known masks such as random masks having complement relation to each other may be used to divide one page of image into three image data. Thus generated first divided image data (first CMYK binary data) becomes the ink ejection data to be supplied to an ink ejection head 3*a*IH of the image forming portion 3*a*. Similarly, the second divided image data becomes the ink ejection data to be supplied to an ink ejection head 3*b*IH of the image forming portion 3*b* and the third divided image data becomes the ink ejection data to be supplied to an ink ejection head 3*c*IH of the image forming portion 3*c*.

Next, the image processing section generates reaction liquid ejection data based on the first, second and third divided image data (the first, second and third CMYK binary data). Specifically, for generating a first reaction liquid ejection data to be supplied to a reaction liquid ejection head 3*a*SH of the image forming portion 3*a*, calculating a logical sum of respective color data included in the first divided image data (a logical sum of C data, M data, Y data, K data) is performed. Then, the logical sum data is made the first reaction liquid ejection data. Thus, the reaction liquid can be ejected to all positions (pixels) to which any of C, M, Y and K ink is ejected according to the first divided image data. Further, for generating a second reaction liquid ejection data to be supplied to a reaction liquid ejection head 3*b*SH of the image forming portion 3*b*, calculating a logical sum of respective color data included in the second divided image data is performed. Thus obtained logical sum data is made the second reaction liquid ejection data. Similarly, for generating a third reaction liquid ejection data to be supplied to a reaction liquid ejection head 3*c*SH of the image forming portion 3*c*, calculating a logical sum of respective color data included in the third divided image data is performed. Thus obtained logical sum data is made the third reaction liquid ejection data. The above processes completes generation of the ink ejection data (divided image data) and the reaction liquid ejection data to supplied three image forming portions (3*a*, 3*b*, 3*c*).

When above described data generation by the image processing portion 105 is completed, image forming is performed based on the ink ejection data and the reaction liquid ejection data. First, the image forming and drying by the first section is performed. Specifically, the reaction liquid is ejected onto a surface layer of the intermediate transfer body 1 from the reaction liquid ejection head 3*a*SH of the image forming portion 3*a*, based on the first reaction liquid ejection data and then ink is ejected to the layer from the ink ejection head 3*a*IH of the image forming portion 3*a* based on the first divided image data. As a result, a part (divided image A) of a final complete image 8 is formed on the surface layer of the intermediate transfer body 1. Successively, the drying portion 4*a* which has high drying power dries the divided image A during relatively short time (T2) to remove extra liquid components included in the image. Next, the image forming and drying by the second section is performed. Specifically, the reaction liquid is ejected from the reaction liquid ejection head 3*b*SH of the image forming portion 3*b* based on the second reaction liquid ejection data and then ink is ejected from the ink ejection head 3*b*IH of the image forming portion 3*b* based on the second divided image data. As a result, a divided image B forming a part of the complete image 8 is formed. Successively, the drying portion 4*b* which has high drying power dries the divided images A and B during relatively short time (T2) to remove extra liquid components included in the image. Finally, the image forming and drying by the third section is performed. Specifically, the reaction liquid is ejected from the reaction liquid ejection head 3*c*SH of the image forming portion 3*c* based on the third reaction liquid ejection data and then ink is ejected from the ink ejection head 3*c*IH of the image forming portion 3*c* based on the third divided image data. As a result, a residual part (divided image C) of the complete image 8 is formed. Successively, the drying portion 4*c* which has lower drying power than that of the drying portions 4*a* and 4*b* dries the complete image 8 (an image formed b superimposing the divided images A, B and C) during relatively long time (T1) to remove extra liquid components included in the complete image 8 so that a residual amount in the complete image is within the adequate range. As a result, the image on the surface layer of the intermediate transfer body 1, which corresponds to one page of image to be transferred, is completed. Thus completed image is transferred from the intermediate transfer body 1 to a printing medium and thus the image is formed on the printing medium.

The intermediate transfer body 1 is required to have a running stability in addition to rigidity endurable to pressure during the transfer operation and dimensional accuracy. Accordingly, in the intermediate transfer body 1 according to the present embodiment, a belt made of light metal such as aluminum base alloy is used as a support of the surface layer of the intermediate transfer body 1, and the nonabsorbent (impermeable) surface layer is formed on a surface of the belt. Further, the intermediate transfer body 1 of the present embodiment is structured so that the surface layer of the transfer body is in line contact with the printing medium 7 by the pressure roller 5.

In addition, as for the intermediate transfer body 1 according to the present embodiment, the belt made of light metal is used in consideration of the above reasons; however, the intermediate transfer body 1 according to the present invention is not limited to the above-described material. For example, a belt made of metal, glass, plastics, rubber, cloth or adequate combination of these materials may be used.

Further, the intermediate transfer body 1 according to the present embodiment is belt-like such that the surface layer has line contact with the printing medium 7; however, the present invention is not limited to the above-described shape. In other words, for example, the intermediate transfer body in the form of drum or sheet may be used in accordance with configurations of an image printing apparatus to be applied or aspects of the image transfer to the printing medium. Further, depending on the shape of the printing medium, as the intermediate transfer body, there can be used a configuration such that the surface layer has not line contact with the printing medium 7, for example, also a material having large elastic deformation like a printing pad.

Further, for the surface layer according to the present embodiment, a nonabsorbent material is used; however, it is not limited to the nonabsorbent material for the surface layer according to the present invention. In this connection, it is desired that a releasing material is used in terms of improvement in transfer characteristics. Specifically, for example, releasing materials such as materials containing fluorine compound or silicone compound may be used for the surface layer. Here, the releasing property is a property that a material such as the ink and reaction liquid applied to a surface is hard to be adhered and then can be peeled. In this connection, as the releasing property is higher, it is more advantageous in terms of load during the cleaning or transfer characteristics of the ink. On the contrary, a critical surface tension of the material is reduced and the material has a lyophobic property such that a liquid such as ink is hard to be adhered to a surface, and therefore, it becomes difficult to keep the image. Accordingly, it is preferred that a hydrophilization treatment is previously performed, if desired, for the purpose of enhancing wettability (surface energy) of the surface layer of the intermediate transfer body. For the hydrophilization treatment means, the present embodiment is not particularly limited and a known method can be used. Particularly, a hydrophilicity process that is combined with application of energy such as plasma treatment and application of liquid containing surfactants is preferable.

Further, it is desirable that an elastic body is used as a material for the surface layer of the intermediate transfer body 1. For an elastic body, there can be preferably used urethane rubber having applied thereto a surface treatment, and fluorocarbon rubber or silicone rubber having ink repellent characteristics in a material itself. The silicone rubber has various types such as vulcanization type, one-pack curable type, and two-pack curable type, and any type can be preferably used. The hardness of rubber of the surface layer made of an elastic body is affected by thickness or hardness of the printing medium 7 that is brought into contact with the surface layer. It is effective to use a material having hardness in a range from 10 to 100°, and further, it is more desired to use a material having hardness in a range from 40 to 80°.

In the present embodiment, aqueous ink is used as ink for printing an image, and nonabsorbent surface layer is used as the surface layer of the intermediate transfer body. In the case of using this combination, the ink applied to the intermediate transfer body 1 is flowing out if nothing is done, and beading or bleeding occur. To cope with the above-described problem, before applying the ink, it is desired to apply the reaction liquid to the intermediate transfer body for the purpose of suppressing fluidity of the ink on the intermediate transfer body. When a reaction liquid is applied to the intermediate transfer body, the ink and the reaction liquid come in contact with each other on the intermediate transfer body. Therefore, the fluidity of the ink on the intermediate transfer body is decreased and the ink can be kept on a landing point. For this reason, in the present embodiment, each of the image forming portions 3*a*, 3*b* and 3*c* includes the reaction liquid ejection head for ejecting the reaction liquid.

Here, the decrease of ink fluidity means that decreasing of the fluidity is overall found in ink or decreasing of the fluidity is locally found in ink which is caused by solid contents (colorant and resin) in the ink agglutinating. Accordingly, the reaction liquid may be anything that decreases the fluidity of ink on the intermediate transfer body, and particularly, a liquid containing a material that agglutinates the components in the ink (colorant or resin) is preferable.

The above-described reaction liquid is required to be appropriately selected according to a type of the ink used for the image formation. For a dye ink, for example, it is effective to use a polymer coagulant. For pigment ink (having fine dispersed particles), it is effective to use metal ions.

The polymer coagulants include, for example, cationic polymer coagulants, anionic polymer coagulants, nonionic polymer coagulants, and amphoteric polymer coagulants. Metal ions include, for example, divalent metal ions such as $Ca^{2+}$, $Cu^{2+}$, $Ni^{2+}$, $Mg^{2+}$, and $Zn^{2+}$, and trivalent metal ions such as $Fe^{3+}$ and $Al^{3+}$. If a liquid containing these metal ions is applied, it is preferably applied in the form of a metal salt solution in water. Anions of metal salts include, for example, $Cl^-$, $NO_3^-$, $SO_4^{2-}$, $I^-$, $Br^-$, $ClO_3^-$ and $RCOO^-$ (R represents an alkyl group).

For the purpose of improving the durability of the image finally formed, a water-soluble resin and a water-soluble cross-linking agent may be added. There is no limitation in these materials used, when they can coexist with ink coagulation components. As the water-soluble resin, particularly when metal salts having high reactivity are used as the ink coagulation components, PVA and PVP are suitably used. As the water-soluble cross-linking agent, oxazoline and carbodiimide, which react with a carboxylic acid suitably used for colorant dispersion in ink, are suitably used.

Further, allicin is a material that can relatively satisfy both of the increasing viscosity of ink and the image durability. Further, for the purpose of uniformly coating the reaction liquid, it is effective to add the above-described surfactant to the reaction liquids.

As means for applying the reaction liquid, in the present embodiment, the reaction liquid ejection head is employed. However, the reaction liquid applying means of the present invention is not limited to the above-described reaction liquid ejection head. For example, a known coating apparatus such as a spray coater and a roll coater can be used. When using the inkjet method, the reaction liquid can be selectively applied to only apart corresponding to an image formed on the intermediate transfer body. Meanwhile, when using the coating method, the reaction liquid can be more uniformly applied to the intermediate transfer body as in an extremely small dot or thin film. Further, the coating method needs not to generate reaction liquid applying data. Thus, the above-described methods have different merits from each other and therefore may be appropriately selected or combined to be used according to required characteristics or cost.

In the case of applying the reaction liquid by the coating method, it is appropriate that a reaction liquid coating roller is provided only in the image forming portion 3*a* which performs first image information and is not provided in the image forming portions 3*b* and 3*c*. More specifically, if the reaction liquid coating roller is provided in each of the image forming portions 3*b* and 3*c*, the reaction liquid coating rollers contact with ink image formed by the image forming portion 3*a*. Then, the ink image may be transfer to the reaction liquid coating rollers. To prevent such problem from occurring, an arrangement that the reaction liquid coating roller is provided only in the image forming portion 3*a* is preferable. In the arrangement that the reaction liquid coating roller is provided only in the image forming portion 3*a*, first the reaction liquid is applied on whole area of image formation area on the intermediate transfer body by using a reaction liquid coating roller, and then ink is ejected from an ink ejection head of the image forming portion 3*a*. Next, ink is ejected from an ink ejection head of the image forming portion 3*b* and finally ink is ejected from an ink ejection head of the image forming portion 3*c*. As a result, an ink image formed with the ink and reaction liquid is completed. It depends on adhesive force of an ink image and the intermediate transfer body, a material for the reaction liquid or the like whether or not the ink image is transferred to the reaction liquid coating roller and therefore there may be a case that the ink image is not transferred to the reaction liquid coating roller. Accordingly, in the case that the ink image is almost not transferred to the reaction liquid coating roller, the reaction liquid coating rollers may be provided in the image forming portions 3*b*, 3*c*.

In the present embodiment, an ink jet head of a line head type is used in which ink jet ejection openings are arranged over a whole range of image formation in a direction perpendicular to a direction of going around (conveying direction) of the intermediate transfer body, for performing image formation by ejecting ink onto the intermediate transfer body from the line type head. However, in the present invention, a printing head in which ink ejection openings are arranged in the direction of going around of the intermediate transfer body 1 may be used, for performing image formation by ejecting ink onto the intermediate transfer body sequentially while performing scanning of the printing head in a direction perpendicular to the direction of going around. In addition, ink colors used for forming an image are not limited to four colors of CMYK, but light color inks such as light cyan and light magenta and particular colors such as red, blue, white may be used. In addition, an ink jet head used in the present invention is not limited by ink ejection method and a configuration of the head, and printing elements used for applying ejection energy to ink may be an electro-thermal conversion element (heater element) or an electromechanical conversion element (piezoelectric element).

Further, ink used in the present invention is not limited to the above described aqueous ink and may be an oil-based ink. However, in the present embodiment, since the aqueous ink has small adverse effect for surroundings and the embodiment uses coagulation reaction, the aqueous ink is used. The aqueous ink has general dyes or pigments as colorants, and has an aqueous liquid medium for dissolving and/or dispersing the dyes or pigments. Particularly, the pigment ink, since printing image having excellent durability is obtained, is preferably used.

Examples of the dyes include C.I. Direct Blue 6, 8, 22, 34, 70, 71, 76, 78, 86, 142, 199, C.I. Acid Blue 9, 22, 40, 59, 93, 102, 104, 117, 120, 167, 229, C.I. Direct Red 1, 4, 17, 28, 83, 227, C.I. Acid Red 1, 4, 8, 13, 14, 15, 18, 21, 26, 35, 37, 249, 257, 289, C.I. Direct Yellow 12, 24, 26, 86, 98, 132, 142, C.I. Acid Yellow 1, 3, 4, 7, 11, 12, 13, 14, 19, 23, 25, 34, 44, 71, C.I. Food Black 1, 2, and C.I. Acid Black 2, 7, 24, 26, 31, 52, 112, 118.

Examples of the pigments include C.I. Pigment Blue 1, 2, 3, 15:3, 16, 22, C.I. Pigment Red 5, 7, 12, 48 (Ca), 48 (Mn), 57 (Ca), 112, 122, C.I. Pigment Yellow 1, 2, 3, 13, 16, 83, Carbon Black No. 2300, 900, 33, 40, 52, MA 7, 8, MCF 88 (manufactured by Mitsubishi Chemical Corporation), RAVEN 1255 (manufactured by Columbia), REGAL 330R, 660R, MOGUL (manufactured by Cabot), Color Black FW1, FW18, S170, S150, and Printex 35 (manufactured by Degussa Inc.).

These pigments can be used in the form of, for example, self dispersion type, resin dispersion type and microcapsule type. As pigment dispersions used at this time, a water-soluble dispersion resin with a weight-averaged molecular weight of about 1,000 to 15,000 may be suitably used. More specifically, for example, they include block or random copolymers and salts thereof made from vinyl water-soluble resin, styrene and its derivatives, vinylnaphthalene and its derivatives, aliphatic alcohol esters of $\alpha,\beta$-ethylenically-unsaturated carboxylic acid, acrylic acid and its derivatives, maleic acid and its derivatives, itaconic acid and its derivatives, or fumaric acid and its derivatives.

For the purpose of improving the durability of the image finally formed, a water-soluble resin and a water-soluble cross-linking agent may be added. There is no limitation in the materials used, provided that they can coexist with ink components. As the water-soluble resin, the resin to which the above-described dispersion resin is further added may be suitably used. As the water-soluble cross-linking agent, oxazoline and carbodiimide, which have slow reactivity, may be suitably used in terms of ink stability.

In an aqueous medium that makes up the ink together with the above-described colorant, an organic solvent can be contained. The amount of this organic solvent becomes a factor for deciding a solid state property of ink after the increasing viscosity using the after-mentioned process. In the method using the intermediate transfer body 1 according to the present embodiment, since the ink almost consists of colorant and an organic solvent having a high boiling point when transferred to the printing medium, the ink is designed to have an optimum value thereof. The organic solvent used is preferably water-soluble material having a high boiling point and a low vapor pressure, as described below.

The organic solvents may include, for example, polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether or glycerin. Two or more kinds selected from the above-described solvents can be mixed and used. Further, as a component to adjust viscosity and surface tension of ink, alcohols such as ethyl alcohol and isopropyl alcohol or surfactants may be added to ink.

Particularly, there is no limitation also in a compounding ratio of components making up the ink. The compounding ratio can be adjusted properly in an ejectable range from the selected inkjet image forming system, ejection force and nozzle diameters of the ink jet head. In general, the ink that is composed of 0.1 to 10% colorant, 3 to 40% solvent, 0.01 to 5% or less surfactant, and the remaining percentage of purified water based on mass may be used.

Next, an image drying step according to the present embodiment will be described. The image drying step is a step of drying an image by removing extra liquid components in the ink image formed on a surface layer of the intermediate transfer body 1. The drying portions 4*a*, 4*b* and 4*c* perform processes for accelerating removing of water and solvent components in the image formed on the surface layer of the intermediate transfer body 1. Specifically, the drying portion may include a known drying acceleration device such as a blowing device, heating device (for example, IR dryer machine), a squeegee (roller or blade), an external blotter device, a vacuum device, a skiving device, and an air knife device. Further, a part or the whole of a single drying portion (e.g., the drying portion 4*a*) can be used as a natural drying portion; however, the above-described drying promotion device is desired to be used.

The drying portions (4*a*, 4*b*, 4*c*) according to the present embodiment are disposed with non contact with and opposed to the surface layer of the intermediate transfer body 1 as shown in FIG. 2, and is a blowing device for applying a hot air to the image formed on the surface layer. However, the present invention is not limited to the above-described configuration. For example, there may be used a configuration in which a heating roller which contacts with a back surface side of the hollow intermediate transfer body 1 to perform heating, a configuration that an air trunk from one blowing device is divided to provide air supply openings on three drying portions, and other configurations.

Here, a drying power by the drying portion will be described. The "drying power" means an amount of a component removed per unit of time, which is one of components contained in the ink and is most vaporizable, and is expressed Y (g/sec). The smaller the value of Y (g/sec), the lower the drying power is. The ink in this case means initial ink that is not dried. The components that are most vaporizable include water in a case of aqueous ink and diol in a case of solvent ink.

As long as the amount of change in liquid content can be measured, a method for measuring the removed amount is not particularly limited. For example, there can be used a spectroscopic measurement method, a measurement method for using a speed change of an interference pattern of particles (manufactured by Formal Action Co., Ltd; HORUS), a weight measuring method using an electronic balance, or various known methods; further, the method can be arbitrarily selected according to the configuration of the apparatus or used liquid components. Particularly, in the case of using the spectroscopic measurement method, a wavelength used according to a volatile liquid component contained in the used liquid can be arbitrarily selected, and spectrums before and after the drying operation are compared. Thereby, since the amount of reduction in the objective volatile liquid component can be measured, the mixed solvent ink is preferably measured.

Figure 3A:
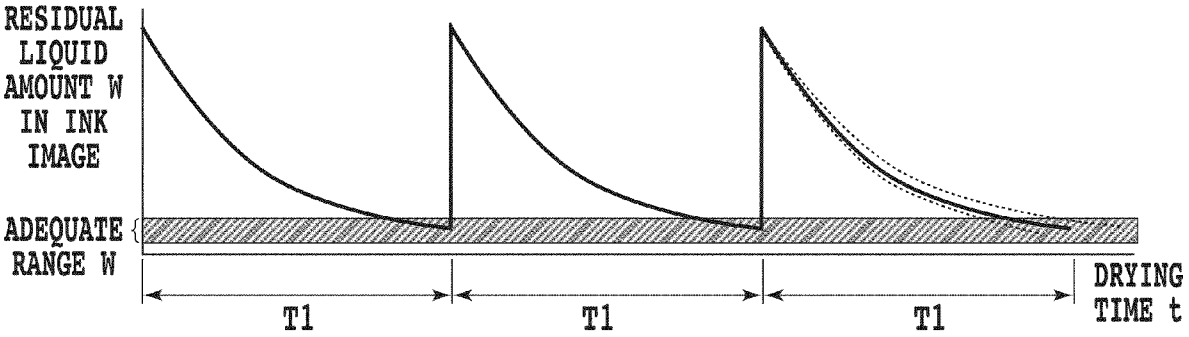
FIG. 3A is a graph showing a relation between a change (drying state) in residual liquid amount in an ink image and drying time according to a prior art.
Figure 3B:
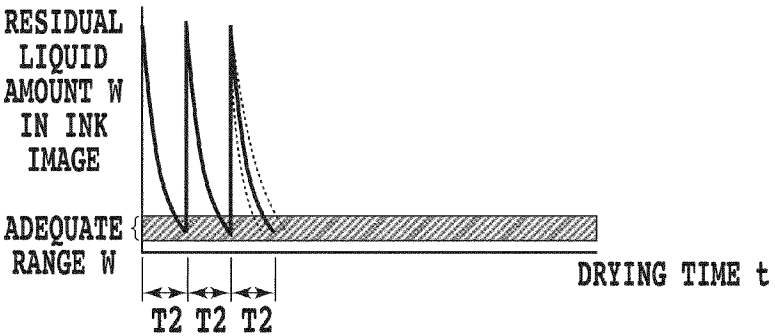
FIG. 3B is a graph showing a relation between a change (drying state) in residual liquid amount in an ink image and drying time according to a prior art.
Figure 3C:
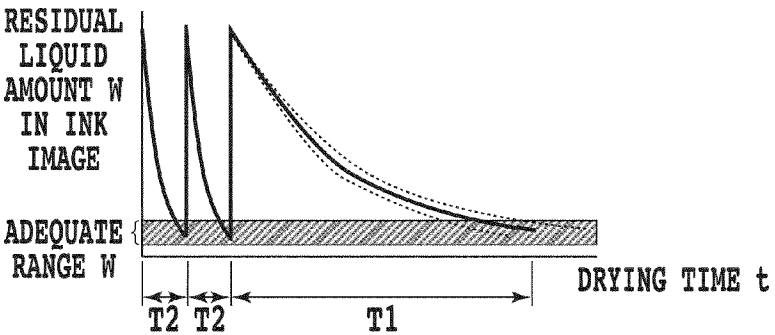
FIG. 3C is a graph showing a relation between a change (drying state) in residual liquid amount in an ink image and drying time according to a prior art according to the first embodiment.

In the present embodiment, the drying power of the drying portion 4*c* that performs a final drying operation (final drying step) is lower (weaker) than those of the drying portions 4*a* and 4*b* that perform the drying operations except the final drying operation (the drying steps except the final drying step). Therefore, blowing temperature of the drying portion 4*c* is set to be lower than respective blowing temperature of the drying portions 4*a* and 4*b*. The drying time (T1) by the drying portion 4*c* (the final drying step) is set to be longer than the respective drying time (T2) by the drying portions 4*a* and 4*b* (the drying steps except the final drying step). As a result, as shown in FIG. 3C, the drying operations except the final drying operation is performed with relatively a strong condition and in a rapid motion (at short times) for responding to speeding up of printing operation. On the other hand, the final drying operation is performed with a weak condition and in a slow motion (at long times) not to deviate from the adequate rang of the drying as shown in FIG. 2 and thus secures a transfer stability. As a result, the transferring with adequate drying state can be always performed while printing is performed at high speed.

An advantageous effect of the present invention will be described below, with reference to FIGS. 3A to 3C. According to the present invention, as shown in FIG. 3*c*, three times of drying operation, among which first two drying operations performs drying with high drying power and during short drying time (T2), are performed. This can eliminate a case that the throughput decreases when performing three drying operations with low drying power as shown in FIG. 3A. At the same time, the present embodiment causes the third (final) drying operation to be of low drying power and long drying time (T1). As a result, even if a drying state changes due to change in a surrounding environment (temperature, humidity or the like) of an apparatus, only performing the drying operation of the predetermined drying time (T1) allows the residual liquid amount to be readily within the adequate range. In other wards, a slope of drying curve corresponding to the low drying power is small so that a deviated amount by which the residual liquid amount at the time T1 deviates from a predetermined residual liquid amount within the adequate range is small. As a result, the residual liquid amount at the transfer readily has an amount within the adequate range, even if the drying state changes.

As described above, according to the present embodiment, a throughput due to times for a drying operation can be restrained from decreasing and a transfer failure due to less drying or over drying can be prevented from occurring to achieve the transfer stability.

A control parameter for the drying power in each drying portion is not limited to that of the above embodiment. For example, in the case of drying by blowing, a blowing speed, a blowing air volume, a humidity of blowing air, a blowing air direction or the like are used as the control parameter, other than the above described air temperature. Generally, the higher the air temperature, the higher the blowing speed, the larger the air volume and the lower the air humidity, the higher the drying power becomes. The blowing air direction may be adjusted taking into account an angle between the surface of intermediate transfer body and the air direction or into account a distribution of the blowing air on the surface of intermediate transfer body, so as to accelerate moving of a vapor in an interface between the surface of intermediate transfer body and the air. In the case of employing the IR dryer machine, a light intensity, a distance between a lump and the intermediate transfer body or the like is used as the control parameter. The stronger the light intensity and the shorter the distance, the higher the drying power becomes. In the case of performing vacuum drying, a degree of vacuum, a speed decreasing pressure or the like is used as the control parameter. The higher the degree of vacuum (depressurization), the higher the drying power becomes. It should be noted that rapid depressurization may cause bumping of a liquid to cause troubled image. In the case of performing an external blotter drying using a contact medium such as a water (liquid) absorption sheet, a material property of the contact medium, a contact area, removing speed of the liquid from contact medium that has absorbed the water (liquid), or the like is used as the control parameter. The contact media fall roughly two types of a contact medium which absorbs the water (liquid) itself and of a contact medium which is permeable to the liquid such as a filter. Selectivity to a type of liquid, absorbing speed of the water (liquid) or the like is different depending on material properties of contact media. Specifically, in a latter case, the drying power becomes higher, the higher the removing speed of the liquid, which has permeated the contact medium, by sucking the liquid at a reverse side of the contact medium.

Figure 1:
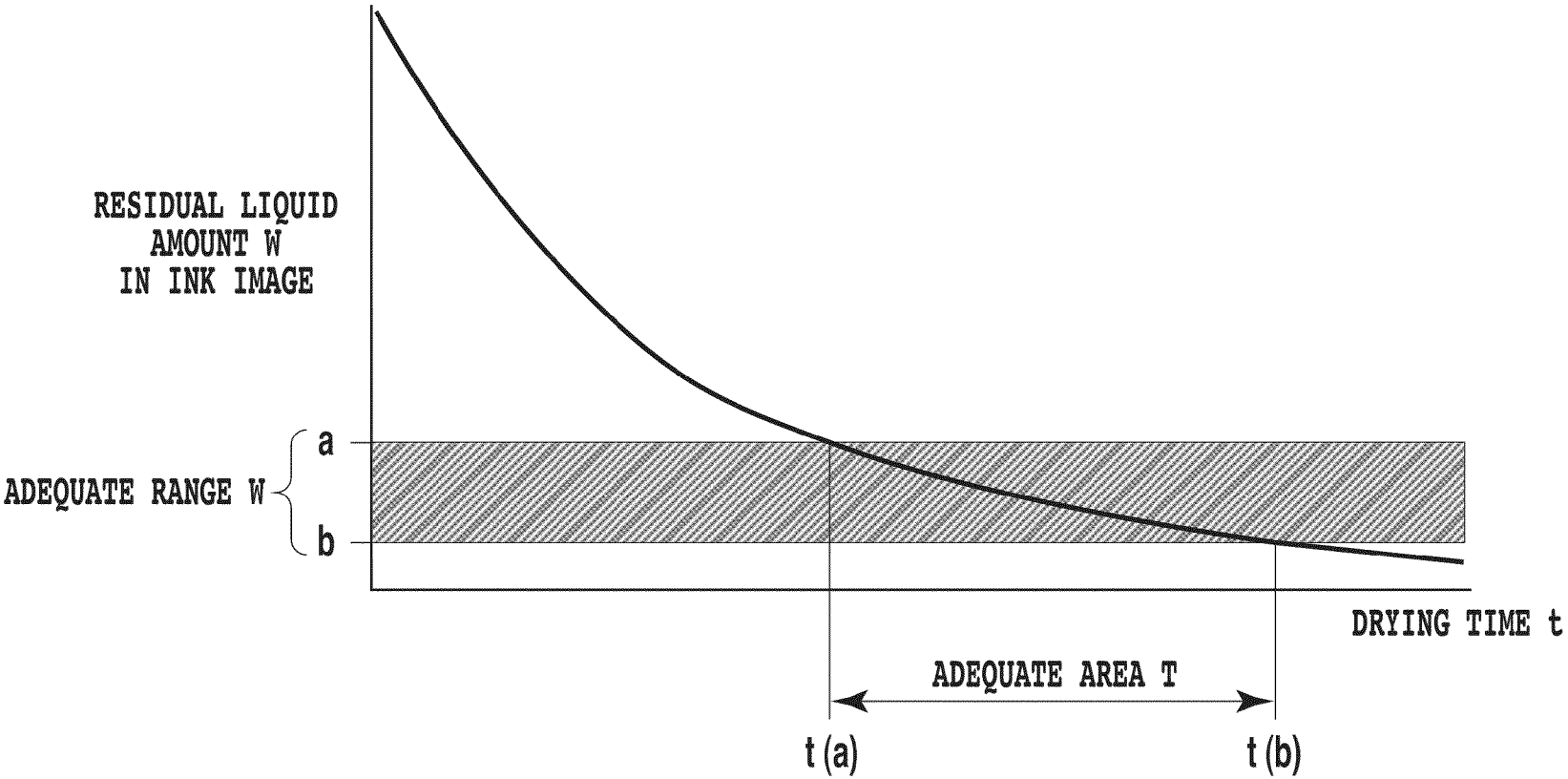
FIG. 1 is a graph showing a relation between a change (drying state) in residual liquid amount in an ink image and drying time.

An adequate drying state in the present embodiment is a state that the transferring of an image can be performed without decreasing quality of an image on a printing medium at the time of transferring. More specifically, it is preferable that a residual amount of liquid in an ink image falls within an adequate range such as the adequate range W shown in FIG. 1. An upper limit of the adequate range ("a" of FIG. 1)

corresponds to a residual amount of liquid at which the image flowing starts to occur and the lower limit of the adequate range ("b" of FIG. 1) corresponds to a residual amount of liquid at which the transfer residue starts to occur.

The residual amount of liquid at the time of transferring is affected by an inner cohesive force and an adherence property of the ink on the intermediate transfer body. Accordingly, the residual amount or the drying state greatly affects a transferring property and thus becomes important to a quality of image on the printing medium. If the drying is proper performed, the inner cohesive force of ink becomes greater with removing of the liquid component and the image flowing is prevented from occurring. As a result, an adequate amount of ink image is transferred from the intermediate transfer body to the surface of printing medium with keeping the image quality.

However, if the drying is inadequately performed, the inner cohesive force of an ink drop is insufficient due to over residual liquid component and a liquidity of ink remains high. As a result, when the ink image is in contact with the printing medium in a transfer step, the ink drop moves in a direction parallel to a transfer surface to cause the image flowing and thus the image quality is significantly degraded. On the other hand, in the case of over drying, surface energy of the ink is extremely lowered and the adherence of ink to the printing medium is reduced, and thus the separation occurs. As a result, a great amount of ink is prevented from moving to the printing medium, and thereby, caused is deterioration in the image quality such as reduction in an OD value (optical density value), and reduction in glossiness due to deterioration in surface irregularity or surface smoothness. Further, since usage efficiency of ink is reduced, running cost is also disadvantageous.

In addition, a method for determining the adequate range includes, for example, the following methods. First, an ink droplet ejected on the intermediate transfer body from an ink jet head is dried under a predetermined condition, and the remaining amount of liquid component at this time is measured by the above-described spectroscopic method. Then, a change in a shape of the ink droplet before and after the transfer operation is measured, thereby determining the upper limit. Specifically, when the liquid amount is larger than the upper limit of the adequate range, the image is distorted in the conveyor direction due to the transfer operation. Therefore, a tolerance value of distortion of the image may be set to be the upper limit. As for the distortion, a length or area of the image in the conveyor direction can be used as an index. In general, a case where the image distortion after the transfer operation is changed by an average of 10% or more as compared with that before the transfer operation is defined to be the image flowing, and the maximum remaining amount of liquid component in which this image flowing does not occur is set to be the upper limit "a" of the adequate range. Meanwhile, the lower limit can be determined by the ink amount remaining on the intermediate transfer body after the transfer operation. The ink amount can be determined by a method for measuring concentrations on the intermediate transfer body after the transfer operation at a maximum absorption wavelength of each color, a method for performing binarization processing and finding an ink remaining area, or in a combination of these methods. In general, a case where the ink image remains by an average of 3% or more is defined to be the transfer residue, and the minimum remaining amount of liquid component in which this transfer residue does not occur is set to be the lower limit "b" of the adequate range.

Next, the transfer step will be described. The transfer step is a step in which the ink image formed on the surface layer of the intermediate transfer body 1 is transferred to the printing medium 7. The printing medium includes a form of continuous paper such as roll sheet and fan fold sheet, in addition to cut sheet.

The printing medium 7 is brought into contact with an image forming surface of the surface layer of the intermediate transfer body 1 when through a nip portion between the pressure roller 5 and the intermediate transfer body 1. At this time, an image on the intermediate transfer body 1 is transferred to the printing medium by a pressure at the nip portion. In the present embodiment, since the drying state of the image on the surface layer of the intermediate transfer body is kept to be proper while performing the transfer, the image is stably transferred to the printing medium. Additionally, at this time, heating the pressure roller 5 effectively improves transfer propertied, as well as surface smoothness and durability of the image on the printing medium. Further, the printing medium 7 after the transfer operation is pressed or heated, or pressed and heated at the same time by a fixing roller (not shown), if desired, thereby improving the surface smoothness and the durability.

In the printing apparatus illustrated in FIG. 2, the surface layer of the intermediate transfer body 1 after transferring the ink image is cleaned, in preparation for reception of the next image, by the cleaning unit 6 that is disposed at the next stage. Means for performing washing includes direct washing such as means for performing water washing or water wiping while hitting water onto the surface layer in a shower-like manner, and means for bringing the surface layer into contact with the water surface. Further, there may be used a wiping-washing means for bringing a sponge or Morton roller containing water or detergent into contact with the surface layer, or a dry washing means for attaching and detaching an adhesive tape. Further, the above-described means may be used at the same time. Further, a method for bringing a dried Morton roller into contact with the surface or blowing air onto the surface after the washing is used, if desired, and thereby, the intermediate transfer body surface may be dried.

As described above, according to the present embodiment, a set of process, which includes a step of forming an image onto an intermediate transfer body by an ink jet method and a step of drying the formed image, is repeated to obtain the image and then the obtained image is transferred to a printing medium. In this regard, a drying power at the last drying step is made most low and drying time at the last drying step is made most long. More specifically, in the drying steps other than the last drying step which less affect a transfer stability, a drying operation with a high drying power (strong drying power) and short drying time is performed so that high throughput can be realized, and in the last drying step which most affect the transfer stability, a drying operation with a low drying power (weak drying power) and long drying time is performed so that the transfer stability can be secured. As a result, an image of adequate drying state can be stably transferred without the drying time becoming long more than necessary and therefore a high quality image without a transfer failure can be outputted with high throughput.

In addition, according to the present embodiment, three image forming portions and three drying portions are provided on the printing apparatus; however, the present invention is not limited to the above-described printing apparatus. Two image forming portions and two drying portions may be provided on the printing apparatus, or four or more image forming portions and four or more drying portions may be provided on the printing apparatus. In short, it suffices as long as multiple image forming portions and multiple drying portions are provided on the printing apparatus, and further, the drying power of the last drying portion is most low (weak) and the drying time of the last drying portions is most long.

Second Embodiment

Figure 4:
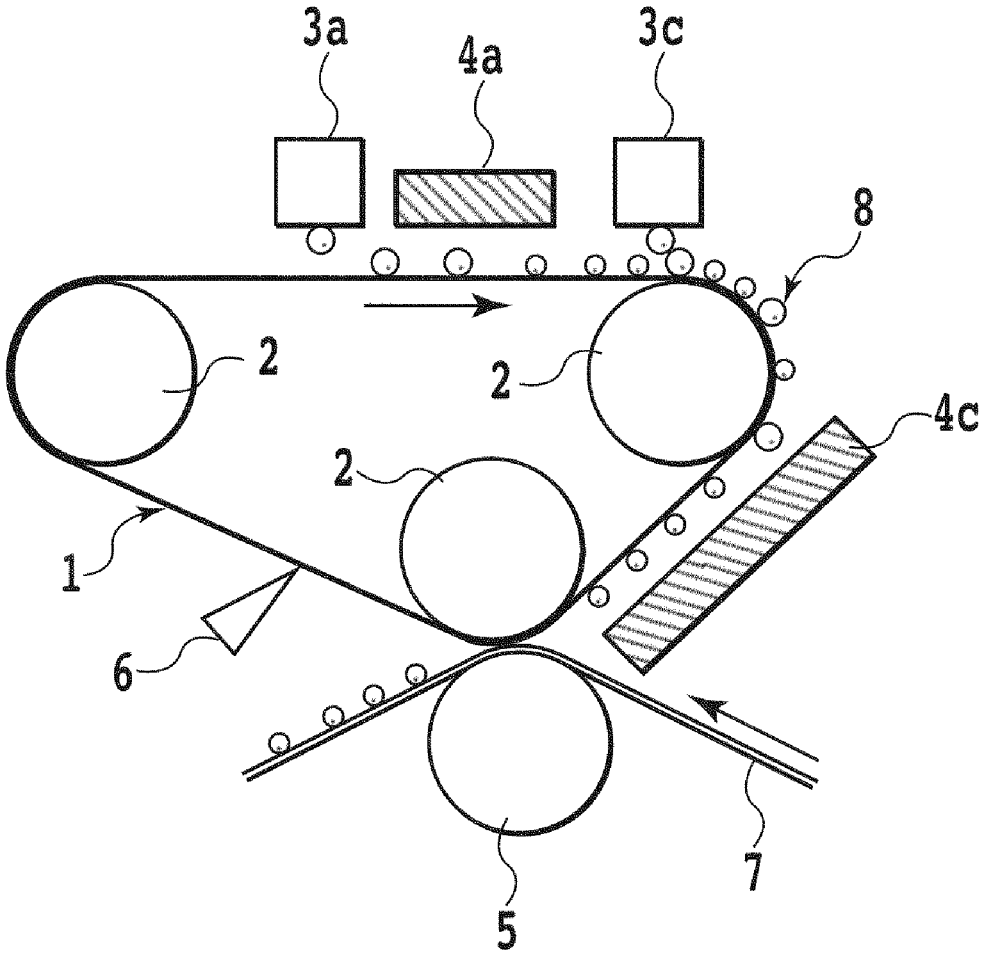
FIG. 4 is a schematic view illustrating an image printing apparatus according to a second embodiment of the present invention.

FIG. 4 is a view especially showing an image forming portion and a drying portion of a printing apparatus according to a second embodiment of the present invention. The printing apparatus of the present embodiment has basically same configuration as the first embodiment shown in FIG. 2, but has following differences. The printing apparatus according to the present embodiment has two sections each of which is consist of an image forming portion and a drying portion. The first section includes the image forming portion 3*a* and the drying portion 4*a* and the second section includes the image forming portion 3*c* and the drying portion 4*c*. That is, while the above described first embodiment performs three steps of image formation and drying, the present embodiment performs two steps of image formation and drying. Among the two steps of drying, as described later with reference to FIGS. 9 and 10, the first drying by the drying portion 4*a* is performed with high drying power and the second drying by the drying portion 4*c* is performed with low drying power.

In the first embodiment, the image data is divided into n-th column of data group, (n+1)-th column of data group and (n+2)-th column of data group by thinning the image by two columns. On the other hand, in the present embodiment, by dividing the image data based on a printing duty as the ink application amount per unit area, a print unevenness is further reduced. Specifically, according to the present invention, a plurality of times of the drying operations are performed to widen the adequate range of the drying time. In this case, the time required for the drying operation varies between a part where the ink application amount per unit area is high (high duty part) and a part where the ink application amount per unit area is low (low duty part). In general, various duty parts mixedly exist in one page of image in many cases. Therefore, the appropriate drying time for all of these duty parts is preferred to be satisfied for the purpose of further keeping image quality on the entire surface of images without unevenness.

To cope with the above-described problem, the image with the high duty part is divided and formed. Thereby, the ink application amount in one inkjet image forming step falls within a certain range, and therefore, an adequate range of the drying time can be more widened in each step.

Hereinafter, a specific division method will be described. For affording convenience for describing the present embodiment, a description will be made on a case where the image is divided into two parts, namely, a method for dividing the image data corresponding to the printing apparatus on which two image forming portions and two drying portions are provided.

(1) Division Method 1

Figure 7:
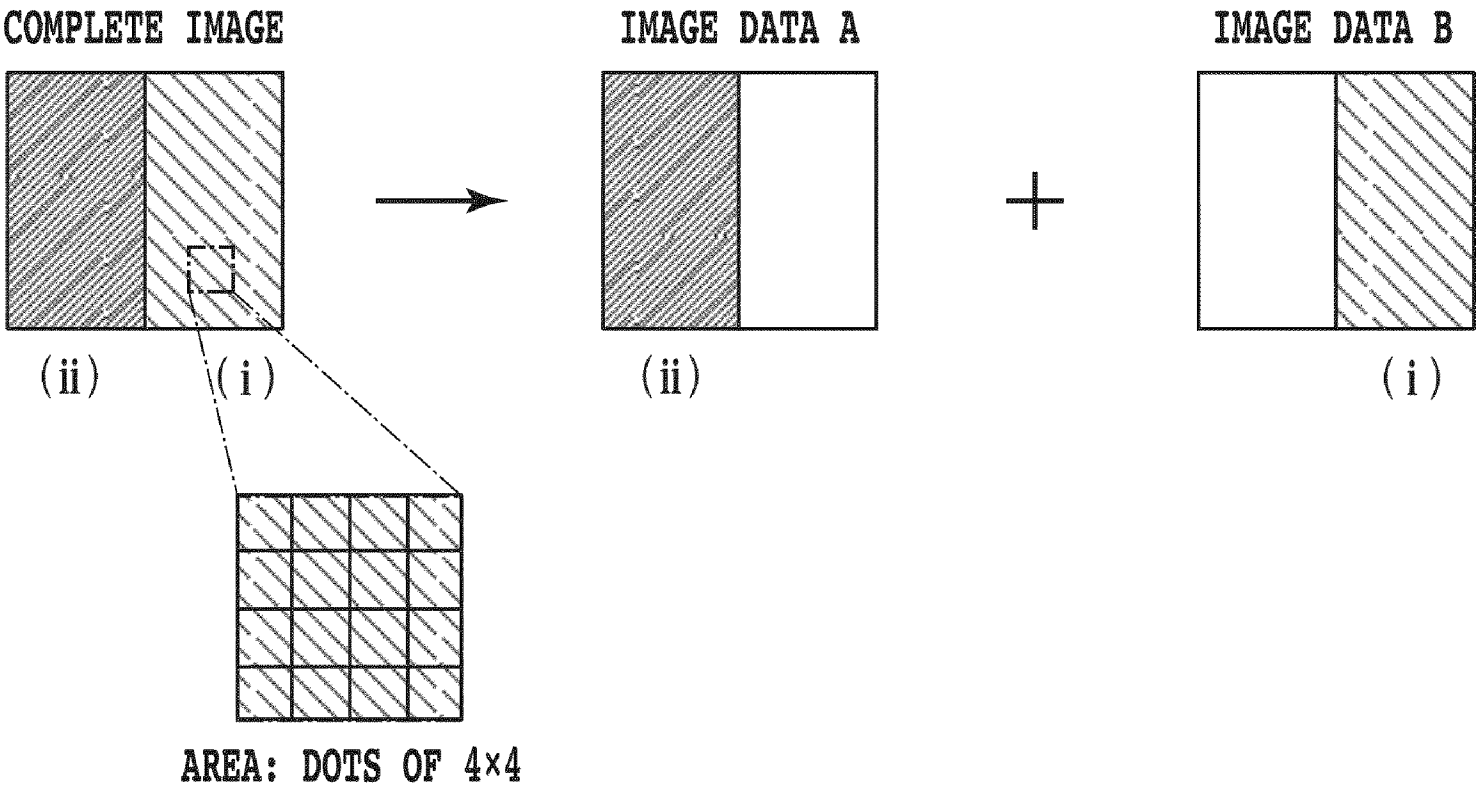
FIG. 7 is an explanatory diagram illustrating one example of an image division method (Division method 1) according to the second embodiment of the present invention.

FIG. 7 is an explanatory diagram illustrating a division method 1 according to the present embodiment. In the division method 1, a case where ink used for forming an image is one color of ink will be described. At first, an area of a predetermined size is used as a unit by which an image is divided. For example, this area may be an area of collecting dot coordinates onto which ink is applied. Here, the image is divided into a lattice by defining as one area a collection (an area of total 16 pixels consist of 4 pixels×4 pixels) of total of 16 dot coordinates (pixels) of 4×4.

Next, the duty is calculated for each area defined in the image as described above. Here, a case where ink is applied to all the dot coordinates (16 pixels) is set to 100%, and the image is divided into an area group (i) whose duties are equal to or greater than 0% and equal to or less than x% and an area group (ii) whose duties are greater than x% and equal to or less than 100%. The image data of each area group is integrated and is replaced by a mirror image data, and each mirror image data is set to image data A corresponding to the area group (ii) and image data B corresponding to the area group (i). It should be noted that an example shown in FIG. 7 is an image including a high density image of a left side half (ii) and a low density image of a right side half (i) and thus being easily distinguished in a sense of sight. However, the present embodiment is of course intended for an image in which the image data A and the image data B are mixed by the above described area of 4 pixels×4 pixels.

Based on the image data divided as described above, the image is formed on the surface layer of the intermediate transfer body 1. Specifically, first the image forming portion 3*a* forms an image of the area group (ii) on the surface layer of the intermediate transfer body 1 according to the image data A, and then the drying portion 4*a* dries the image of the area group (ii). Thereafter, the image forming portion 3*c* forms an image of the area group (i) on the surface layer of the intermediate transfer body according to the image data B, and then the drying portion 4*c* dries the images of the area group (ii) and area group (i) together.

According to the above-described division method, the amount of ink applied to the final image formation can be constantly kept within a certain range regardless of the duty of the original input image. Therefore, the final drying portion with weak drying power can dry the entire image more stably in the adequate area for shorter time. A threshold of the duty is preferably set in consideration of easiness of drying of ink, types of paper, or humidity of the environment.

(2) Division Method 2

Figure 8:
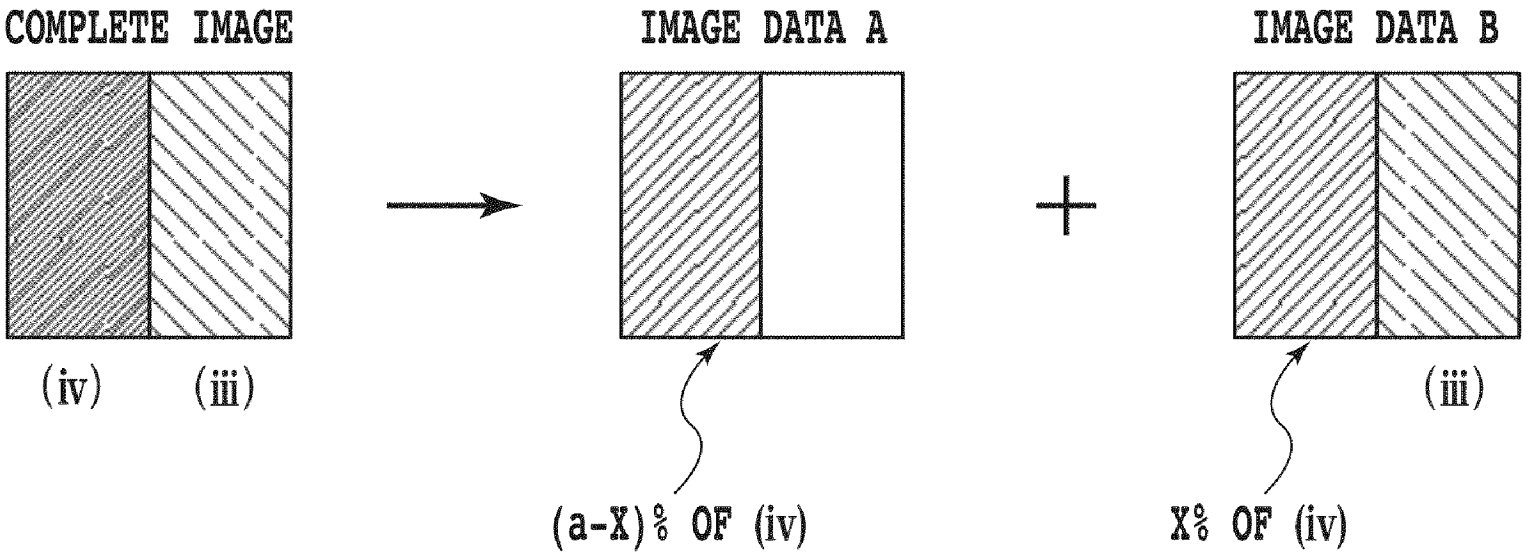
FIG. 8 is an explanatory diagram illustrating one example of an image division method (Division method 2) according to the second embodiment of the present invention.

FIG. 8 is an explanatory diagram illustrating a division method 2 according to the present embodiment. In the division method 2, a case where ink used for forming an image is one color of ink will be described.

Also, in the division method 2, an area of 4 pixels×4 pixels is used as a unit for dividing an image.

Next, the duty (%) is calculated for each area defined in an image. Also in the present example, a case where ink is applied to all the dot coordinates (16 pixels) is set to 100%, and areas of the image for which the duty (%) has been calculated is divided into an area group (iii) whose duties are equal to or greater than 0% and equal to or less than x% and an area group (iv) whose duties are greater than x% and equal to or less than 100%. Further, in the area group (iv) of the high duty part, for each area, data of duty a % is divided into data (iv-1) and data (iv-2) according to a ratio of x: (100−x). For example, when x% is 60% and the duty of the area group (iv) is 80%, the data of duty 80% is divided into the data (iv-1) and data (iv-2) according to a ratio of 60:20. Particularly, there is no limitation in the method for dividing the image into two parts; a known method such as a method for making a choice using a checker pattern mask or random mask can be arbitrarily used. For example, the duty of a mask for data (iv-1) and the duty of a mask for data (iv-2) are made x% and (100−x) %, respectively and then respective data is obtained. For the area group (iii) of the low duty, the image is directly used without further dividing it.

Subsequently, the image data is integrated. The integration is performed as follows. That is, Image data A=data (iv-2) of area group (iv)

Image data *B*=data of area group (*iii*)+data (*iv*-1) of area group (*iv*)

Further, the image data A and B are replaced by respective mirror images to be two image data.

As described above, based on the divided image, an image is formed on the surface layer of the intermediate transfer body. Specifically, first, the image forming portion 3*a* forms a part of image of the area group (iv) on the surface layer of the intermediate transfer body 1 according to the image data A, and then the drying portion 4*a* dries the part of image of the area group (iv). Thereafter, the image forming portion 3*c* forms an image of the area group (iii) and a residual image of the area group (iv) on the surface layer of the intermediate transfer body according to the image data B, and then the drying portion 4*c* dries the images of the area group (iii) and area group (iv) together.

By thus dividing the image, the image data B has a duty part of a ratio of x% or less in all the areas. That is, the liquid application amount per unit area of the image that is finally formed by the image forming portion 3*c* that finally forms the image is a predetermined amount or less. Accordingly, when the image of only this image data B is formed in the final inkjet image forming step, a drying state of the image in a final drying step by the drying portion 4*c* can be more stable.

(3) Division Method 3

In a division method 3, a description will be made on a case where ink of four colors of cyan (C), magenta (M), yellow (Y), and black (K) is used.

First, similarly to the above methods, an area of 4 pixels×4 pixels is used as a unit for dividing an image. For each C, M, Y, K, duty is calculate for each area. Further, the image data for each area is divided into an area group (v) from 0 to x% or less and an area group (vi) of more than x% for each C, M, Y, K.

Next, in the area group (vi) of a high duty, for each color data, the data of each area is divided into data (vi-1) and data (vi-1) according to a ratio of x: (100−x).

Subsequently, the image data is integrated. The integration is performed as follows. That is, $$\text{Image data } A = \text{cyan}\left\{\begin{matrix}\text{data of area group } (v) + \\ \text{data } (vi-1) \text{ of area group } (vi)\end{matrix}\right\} + \text{magenta}\left\{\begin{matrix}\text{data of area group } (v) + \\ \text{data } (vi-1) \text{ of area group } (vi)\end{matrix}\right\} + \text{yellow}\left\{\begin{matrix}\text{data of area group } (v) + \\ \text{data } (vi-1) \text{ of area group } (vi)\end{matrix}\right\} + \text{black}\left\{\begin{matrix}\text{data of area group } (v) + \\ \text{data } (vi-1) \text{ of area group } (vi)\end{matrix}\right\}$$

$$\text{Image data } B = \text{data } (vi-2) \text{ of cyan area group } (vi) + \text{data } (vi-2) \text{ of magenta area group } (vi) + \text{data } (vi-2) \text{ of yellow area group } (vi) + \text{data } (vi-2) \text{ black area group } (vi)$$

Further, the image data A and B are replaced by mirror images and to be two mirror images.

The duty value (x) which is set and used as a threshold in the division methods 1 to 3 can be determined depending on the printing speed of necessity, the type of ink or papers, and the surrounding environment. In addition, the division method based on the duty is not limited to the above-described method. Specifically, it suffices that the image data is divided based on the set duty, and therefore, it may be divided according to a single method, or a suitable combination of the above methods.

Figure 9A:
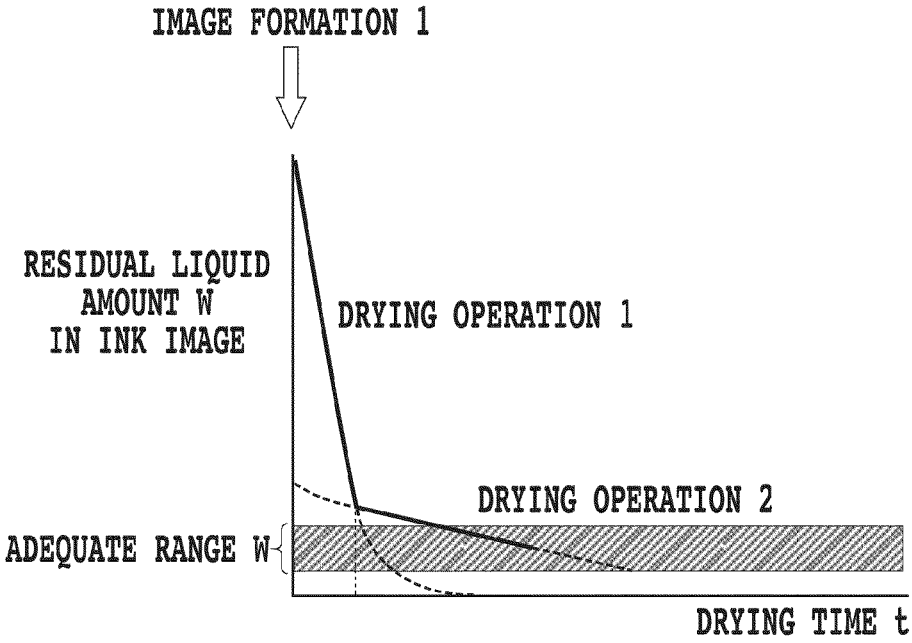
FIG. 9A is a graph showing a relation between a change (drying state) in residual liquid amount in an ink image and drying time, according to the image division method of the second embodiment (Division method 1)

FIG. 9A is a conceptual diagram illustrating a drying state of the image of area group (ii) according to the above described division method 1. The image forming portion 3*a* performs "image formation 1" according to the image data A of the area group (ii). Then, the drying portion 4*a* dries the image of area group (ii). This drying operation designated by "drying operation 1" in FIG. 9A. Specifically, since the drying portion 4*a* has high drying power, the residual liquid amount W decreases in relatively short time. Next, the drying portion 4*c* dries the image of the area group (ii). This drying operation is designated by "drying operation 2" in FIG. 9A. Specifically, since the drying portion 4*c* has low drying power, it is required relatively long drying time for the residual liquid amount W to decrease and become the residual amount within the adequate area.

Figure 9B:
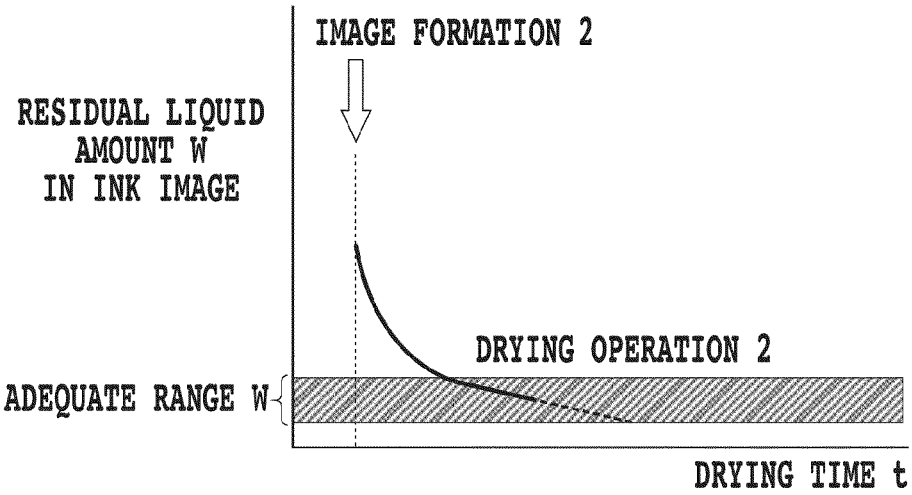
FIG. 9B is a graph showing a relation between a change (drying state) in residual liquid amount in an ink image and drying time, according to the image division method of the second embodiment (Division method 1)

On the other hand, FIG. 9B is a conceptual diagram illustrating a drying state of the image of area group (ii) shown in FIG. 7 related to the above described division method 1. The image forming portion 3*c* performs "image formation 2" according to the image data B of the area group (i). Then, the drying portion 4*c* of the same section to image forming portion 3*c* dries the image of area group (i). This drying operation designated by "drying operation 2" in FIG. 9B. Specifically, since the image of the area group (i) has the duty that is equal to or greater than 0% and equal to or less than x%, an initial value of the residual liquid amount is less than that of the image of the area group (ii). Therefore, as shown in FIG. 9B, though the drying power of the drying portion 4*c* is low, the drying time, which is required for the residual liquid amount W decreasing and being within the adequate area, can be not so different from that in "drying operation 2" for the image of the area group (ii).

As described above, the image formation and drying image can be performed for each area of predetermined size depending on ink density of the area. This allows more close drying control for the ink image to be performed. An amount of ink applied in the final image formation step can be an amount within predetermined range regardless of duty of input image. Accordingly, the final drying step with low drying power can makes the entire image be a drying state within the adequate area in shorter time and in more stable.

Figure 10A:
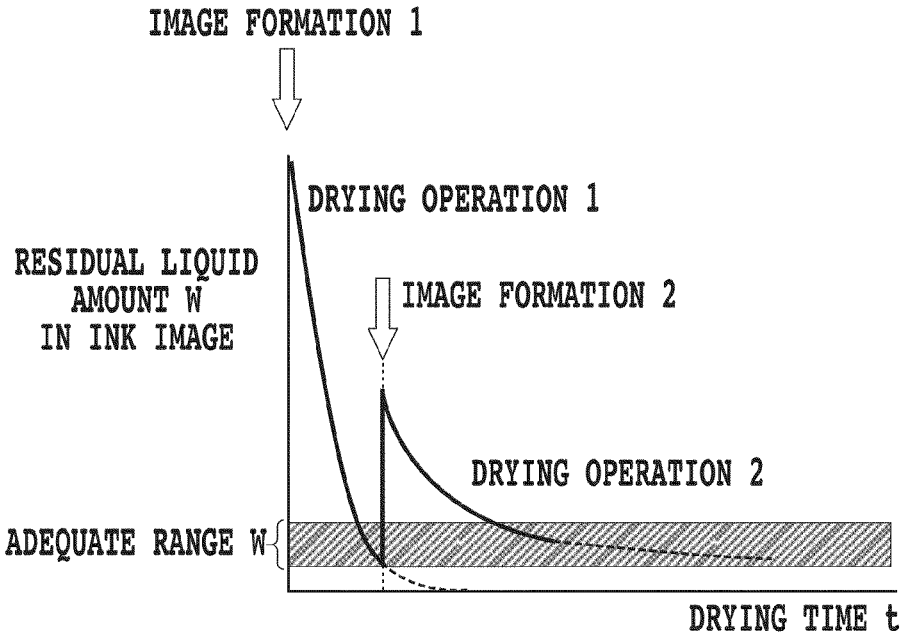
FIG. 10A is a graph showing a relation between a change (drying state) in residual liquid amount in an ink image and drying time, according to the image division method of the second embodiment.

FIG. 10A is a conceptual diagram illustrating a drying state of the image of the area group (iv) shown in FIG. 8 according to the above described division method 2. First, The image forming portion 3*a* performs "image formation 1" according to the data (iv-2). Then, the drying portion 4*a* dries the image of area group (iv). This drying operation designated by "drying operation 1" in FIG. 10A. Specifically, since the drying portion 4*a* has high drying power, the residual liquid amount W decreases in relatively short time and becomes an amount within adequate area. Next, the image forming portion 3*c* performs "image formation 2" onto the area group (iv) on the intermediate transfer body 1 on which "image formation 1" has been performed, according to the data (iv-1). The residual liquid amount at the time of completion of "image formation 2" is a total of the residual liquid amount at the time of completion of "drying operation 1" and an amount of liquid applied according to the data (iv-1). Accordingly, The residual liquid amount at the time of completion of "image formation 2" is out of the adequate area of residual liquid amount. Thereafter, the drying portion 4*c* dries the image of the area group (iv). This drying operation is designated by "drying operation 2" in FIG. 10A. Specifically, since the drying portion 4*c* has low drying power, it is required relatively long drying time that the residual liquid amount W, which has increased once as described above, decreases and becomes the residual amount within the adequate area.

Figure 10B:
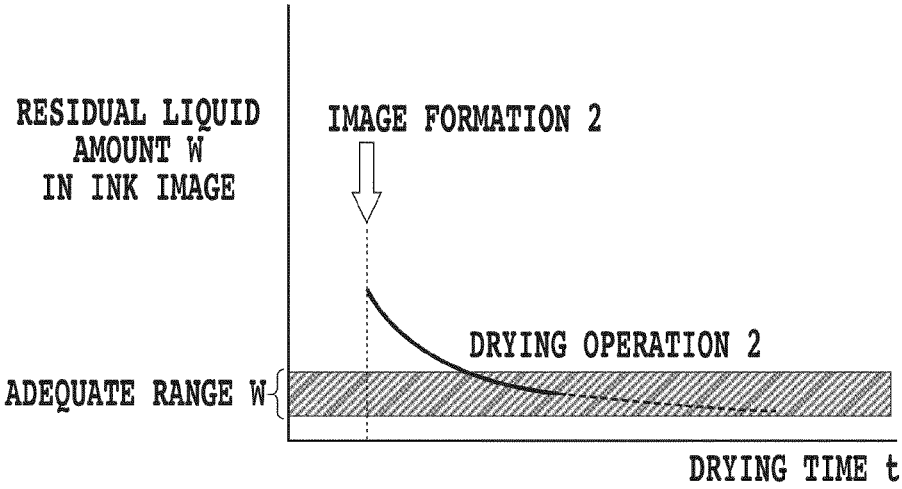
FIG. 10B is a graph showing a relation between a change (drying state) in residual liquid amount in an ink image and drying time, according to the image division method of the second embodiment.

On the other hand, FIG. 10B is a conceptual diagram illustrating a drying state of the image of area group (iii) shown in FIG. 8 related to the above described division method 2. First, the image forming portion 3*c* performs "image formation 2" according to the data (iii). Then, the drying portion 4*c* dries the image of area group (iii). This drying operation designated by "drying operation 2" in FIG. 10B. Specifically, since the image of the area group (iii) has the duty that is equal to or greater than 0% and equal to or less than x%, an initial value of the residual liquid amount is less than that of the images of the area group (iv-1) and area group (iv-2). Therefore, as shown in FIG. 10B, though the drying power of the drying portion 4*c* is low, the drying time, which is required for the residual liquid amount W decreasing and becoming within the adequate area, can be not so different from that in "drying operation 2" for the image of the area groups (iv-1) and (iv-2).

As described above, also in the division method 2, the image formation and drying image can be performed for each area of predetermined size depending on ink density of the area. This allows more close drying control for the ink image to be performed.

As described above, dividing image data based on print duty allows the amount of ink applied in one ink jet image forming step to fall within and thus widen the adequate area for the drying time. That is, when the high duty part is divided into several times to form the image as the present embodiment, the ink application amount in one-time image formation is reduced as compared with the case where the high duty part is not divided into several times.

For example, a description will be made on a case where the image of a solid part with the duty of 150% is formed, and moreover, the image is divided into one part with the duty of 100% and another part with the duty of 50%. In the case where the image is not divided, since ink droplets of the duty of 150% are applied to the intermediate transfer body surface of the duty of 100% at one time, ink droplets are overlapped with each other and also a thickness of the ink increases. Meanwhile, in the case where the image is divided, ink droplets of the duty of 100% are applied to the intermediate transfer body surface in the first inkjet image forming portion. Since the entire intermediate transfer body surface is almost covered with ink, the surface covered with the ink at this time is almost the same as that of the case where the image is not divided; however, since the thickness of the ink is thin, the drying operation is rapidly accelerated. Only ink droplets of the duty of 50% are applied to the intermediate transfer body surface in the final inkjet image forming portion, and therefore, the ink droplets exist separately. Therefore, the surface covered with ink is larger than that of a case where the image is not divided. Accordingly, the drying operation can be quickly performed in the final inkjet image forming portion. As described above, when the image data is divided and the drying operation is performed to each divided image data, the image data can be quickly dried as compared with a case where the image data is not divided.

Further, in the final image formation, among the formations performed a plurality of times in a divided manner, the formation of only images with an arbitrarily-set duty value or less is preferably performed together.

FIG. 10A illustrates a drying state in the area group (iv) of FIG. 8. As illustrated in FIG. 10A, the ink application amount during the final image formation can fall within a certain range regardless of the duty of an original input image. Even if a portion that is overdried is present in the stage before performing the final image formation, a liquid component is freshly applied to that portion, and therefore, the ink amount can be returned to a state of the lower limit or more of the adequate area. Therefore, the entire image can be more stably dried in the adequate area for a shorter time by the final drying portion that is weak in the drying power.

Third Embodiment

Figure 6:
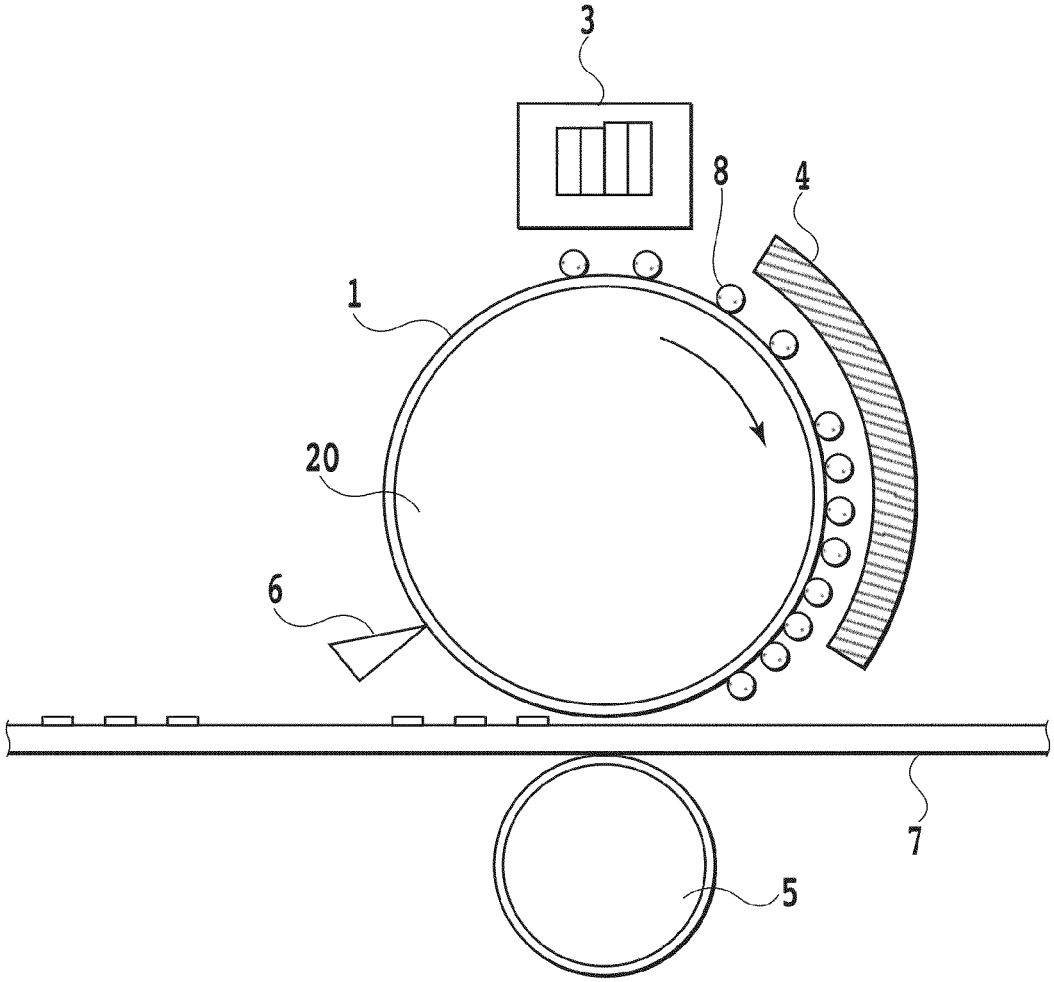
FIG. 6 is a schematic view illustrating an image printing apparatus according to a third embodiment of the present invention.

FIG. 6 is a view a printing apparatus according to a third embodiment of the present invention. The present embodiment employs an intermediate transfer body 1 provided on a drum, in a palace of a belt-like intermediate transfer body shown in the above described embodiments. The intermediate transfer body 1 is formed on a surface of a drum 20. Specifically, the intermediate transfer body is made up by adhering a silicon rubber as the intermediate transfer body to the drum 20 in a predetermined thickness.

As shown in FIG. 6, around the intermediate transfer body 1 formed on the surface of the drum, an image forming portion 3 and a drying portion 4 are provided along a rotating direction of the drum. The drying portion 4 has two parts along the rotating direction into which a range for generating an air for drying is divided, and thus is controlled to selectively generate the air from one part at an upstream side in the rotating direction or from the two parts. Further, the drying portion 4 is adapted to generate the air in two phases of air volumes. The above described drying portion can control the generated air to perform a following drying control.

In the drying control according to the present embodiment, three times of drying processes by the drying portion 4 after three times of image forming processes by the image forming portion 3 are performed respectively by rotating the drum 20 three times at the same speed. Then, in each of first two times of drying processes, the drying portion 4 performs the drying process in which the air of a strong (large) air volume among the two phases of air volume is generated and the air is blown only from the part at the upstream side in the rotating direction. That is, the drying portion performs the drying process with high drying power and short drying time. Further, in final and third drying process, the drying portion 4 performs the drying process in which the air of a weak (small) air volume among the two phases of air volume is generated and the air is blown from the two parts in the rotating direction. That is, the drying portion performs the drying process with low drying power and long drying time. According to the present embodiment, the drying process the same as that explained with reference to FIG. 3C of the first embodiment can be performed.

It should be noted that the intermediate transfer body on the drum keeps separated from a printing medium 7 during processes of image formation and drying by the three times of rotation and only contacts with the printing medium 7 at the transferring.

Example 1

In the present example, there is used an apparatus having a configuration in which two inkjet image forming portions and two drying portions are disposed alternately along the rotation direction of an intermediate transfer body, as shown in FIG. 4. The two inkjet image forming portions apply inks of four colors of cyan (C), magenta (M), yellow (Y), and black (K) to form an image pattern including a plurality of areas having the duty of 0 to 200%. In this image formation, the image data corresponding to the above image pattern is divided into odd column data and even column data so that in the first inkjet image forming portion, ink is applied to every other column according to the odd column data, and in the second inkjet image forming portion, ink is applied to every other column according to the even column data.

(1) Production of Ink

At first, ink of each color of C, M, Y, and K is produced with the following composition.

Each of the following pigments: 3 parts by mass

Black: carbon black (manufactured by Mitsubishi Chemical Corporation; MCF 88)

Cyan: pigment blue 15

Magenta: pigment red 7

Yellow: pigment yellow 74

Styrene-acrylic acid-ethyl acrylate copolymer (acid number: 240, weight-average molecular weight: 5000): 1 part by mass Glycerin: 1 part by mass Ethylene glycol: 10 parts by mass Surfactant (manufactured by Kawaken Fine Chemical Company Ltd; Acetylenol EH): 1 part by mass Ion-exchange water: 84 parts by mass (2) Regulation of Drying Power Using cyan ink produced as described above, a solid patch of the duty of 100% and of 100 mm in width×150 mm in length is produced in the inkjet image formation (nozzle density: 1200 dpi, jetting amount: 4 pl, drive frequency: 12 kHz). In the drying device, air is blown in the direction opposite to the conveying direction of the intermediate transfer body using an air blower (manufactured by Taketsuna Seisakusyo; multi drier HAS-10). The drying power is regulated while changing a wind speed, a temperature in a nozzle, and a distance between the intermediate transfer body and the nozzle for each drying device. The amount of a water removed per unit time, which is a liquid component being most easily vaporized, is measured using an infrared spectrometric apparatus (manufactured by PerkinElmer, Inc.; Spectrum One). Thus, the drying power of each drying device is set as follows.

Drying device P: 29 mg/sec

Drying device Q: 15 mg/sec

Drying device R: 3 mg/sec (3) Image Division

The image data is divided into odd column data and even column data for each color. These divided data are replaced by mirror images respectively. Then, the odd columns of mirror images for all colors are integrated to generate an image data A and the even columns of mirror images for all colors are integrated to generate an image data B.

(4) Inkjet Image Formation 1 onto Intermediate Transfer Body

In the present embodiment, a drum made of aluminum coated with silicone rubber (manufactured by Shin-Etsu Chemical Co., Ltd.; KE30) having rubber hardness of 40° of 0.5 mm thick Is used as the intermediate transfer body. Using an atmospheric pressure plasma irradiating device (manufactured by Keyence Corporation; ST-7000), a surface of the intermediate transfer body is modified under the following conditions.

Irradiation distance: 5 mm

Plasma mode: High

Processing speed: 100 mm/sec

Next, a processing solvent obtained by adding a 0.5 mass % aqueous solution of fluorochemical surfactant (manufactured by Seimi Chemical Co., Ltd; Surflon S-141) into a 10 mass % aqueous solution of calcium chloride dihydrate is coated using a roll coater. Thereafter, by the inkjet image forming apparatus (nozzle density: 1200 dpi, jetting amount: 4 pl, drive frequency: 12 kHz), an image is formed according to the image data A produced as the above "(3) Image division" on the intermediate transfer body, on a surface of which an reaction liquid has been coated, by using the four colors of inks.

(5) Drying Operation 1

Using the drying device P, a blowing time (time for blowing air to one point on the intermediate transfer body) is set at every 0.5 seconds between 0.5 to 2 seconds and air is blown.

(6) Inkjet Image Formation 2 onto Intermediate Transfer Body

An image is formed on the intermediate transfer body according to the image data B produced as the above "(3) Image division", in the same manner as in the item (4).

(7) Drying Operation 2

Using the drying device R, the blowing time is set at every 1 second between 1 to 20 seconds and air is blown.

(8) Transfer of Ink Image

The surfaces of the intermediate transfer body and the printing medium are contact-pressurized, and character images on the intermediate transfer body are transferred to the printing medium.

(9) Results

The adequate range of the drying time is as follows. Time t at which the residual liquid amount begins to go into the adequate area is 4.5 seconds and time t at which the residual liquid amount begins to go out from the adequate area is 15.5 seconds, and thus the adequate range has interval of 11 seconds. Here, the transfer rate of ink became 100%, and excellent image quality could be obtained over the entire image. Further, printing matters are obtained with their printing quality unaffected even if the cleaning unit is detached from this apparatus.

Example 2

In the same manner as in the example 1, there is used an apparatus having a configuration in which two inkjet image forming portions and two drying portions are disposed alternately along the rotation direction of an intermediate transfer body. Two inkjet image forming portions apply four color inks of cyan, magenta, yellow and black to form an image pattern including a plurality of areas of the duty: 0 to 200% on the intermediate transfer body. The duty value as a threshold for the image division is set to be 30%. In the same manner as in the example 1, the ink is produced and the drying power is set, and therefore, the description is omitted.

(1) Image Division

The image data is binarized, and setting 9 dot coordinates of 3×3 as one area, each area is divided into two parts of one area group (i) of 0 to 30% or less and another area group (ii) of more than 30% based on the duty. Next, as to the image data of each color of cyan, magenta, yellow, and black, the image data in each area is further divided according to the above-described division ratio. For example, with regard to cyan, area group (i): the original image data is used without change and is set to be (C-1).

area group (ii): when defining the duty in this area to be "a", the image of the duty "a" is divided according to the ratio 30:(a-30), into data (Cii-1) and data (Cii-2) respectively.

Also, in each color of the other magenta, yellow, and black, the above-described operation is performed in the same manner. Then, the image data is replaced by mirror image data, and the image data is finally integrated as follows.

$$\text{Image data } B=(C\text{-}i)+(M\text{-}i)+(Y\text{-}i)+(K\text{-}i)+(Cii\text{-}1)+(Mii\text{-}1)+(Yii\text{-}1)+(Kii\text{-}1)$$

$$\text{Image data } A=(Cii\text{-}2)+(Mii\text{-}2)+(Yii\text{-}2)+(Kii\text{-}2)$$

(2) Inkjet Image Formation 1 onto Intermediate Transfer Body

An image is formed according to the image data A in the same manner as in the example 1.

(3) Drying Operation 1

Using the drying device P, the blowing time is set at every 0.5 seconds between 0.5 to 2 seconds and air is blown.

(4) Inkjet Image Formation 2 onto Intermediate Transfer Body

An image is formed on the intermediate transfer body according to the image data B in the same manner as in the example 1.

(5) Drying Operation 2

Using the drying device R, the blowing time is set at every 1 second between 1 to 20 seconds and air is blown.

(6) Transfer of Ink Image

The surfaces of the intermediate transfer body and the printing medium are contact-pressurized, and character images on the intermediate transfer body are transferred to the printing medium.

(7) Results

The adequate range of the drying time is as follows. Time t at which the residual liquid amount begins to go into the adequate area is 3 seconds and time t at which the residual liquid amount begins to go out from the adequate area is 15 seconds, and thus the adequate range has interval of 12 seconds. Here, the transfer rate of ink became 100%, and excellent image quality could be obtained in transfer images corresponding to both of the area groups of the original image data sets (i) and (ii). Further, printing matters are obtained with their printing quality unaffected even if the cleaning unit is detached from this apparatus.

Example 3

There is used an apparatus having a configuration in which three inkjet image forming portions and three drying portions are disposed alternately along the rotation direction of an intermediate transfer body, as shown in FIG. 2. The three inkjet image forming portions apply inks of four colors of cyan (C), magenta (M), yellow (Y), and black (K) to form an image pattern including a plurality of areas having the duty of 0 to 200%. The set duty values in the image division is set to 30% and 10%. In the same manner as in the example 1, the ink is produced and the drying power is set, and therefore, the description is omitted.

(1) Image Division

The image data is binarized. Setting 9 dot coordinates of 3×3 as one area, each area is divided into three area groups of one area group (iii) of 0 to 10%, another area group (iv) of more than 10 to 30%, and another area group (v) of more than 30% based on the duty. Next, as to the image data of each color of cyan, magenta, yellow, and black, the image data in each area is further divided according to the division ratio. For example, with regard to cyan, Area group (iii): the original image data is used without change and is set to be data (Ciii).

Area group (iv): when the duty in this area is set to be "a", the image of the duty "a" is divided according to the ratio 10:(a-10), into data (Civ-1) and data (Civ-2) respectively.

Area group (v): when the duty in this area is set to be "b", the image of the duty b is divided according to a ratio of 10:(30-10):(b-30) into data (Cv-1), data (Cv-2) and data (Cv-3).

Also, in each color of the other magenta, yellow, and black, the above-described operation is performed in the same manner. Then, the image data is replaced by mirror image data, and the image data is finally integrated as follows.

$$\text{Image data } E = (Ciii) + (Miii) + (Yiii) + (Kiii) + (Civ-1) + (Miv-1) + (Yiv-1) + (Kiv-1) + (Cv-1) + (Mv-1) + (Yv-1) + (Kv-1)$$

$$\text{Image data } F = (Civ-2) + (Miv-2) + (Yiv-2) + (Kiv-2) + (Cv-2) + (Mv-2) + (Yv-2) + (Kv-2)$$

$$\text{Image data } G = (Cv-3) + (Mv-3) + (Yv-3) + (Kv-3)$$

(2) Inkjet Image Formation 1 onto Intermediate Transfer Body

An image is formed according to the image data G in the same manner as in the example 1.

(3) Drying Operation 1

Using the drying device P, the blowing time is set at every 0.5 seconds between 0.5 to 2 seconds and air is blown.

(4) Inkjet Image Formation 2 onto Intermediate Transfer Body

An image is formed on the intermediate transfer body according to the image data F, in the same manner as in the example 1.

(5) Drying Operation 2

Using the drying device Q, the blowing time is set at every 0.5 seconds between 0.5 to 4 seconds and air is blown.

(6) Inkjet Image Formation 3 onto Intermediate Transfer Body

An image is formed on the intermediate transfer body according to the image data E, in the same manner as in the example 1.

(7) Drying Operation 3

Using the drying device R, the blowing time is set at every 1 second between 1 to 20 seconds and air is blown.

(8) Transfer of Ink Image

The surfaces of the intermediate transfer body and the printing medium are contact-pressurized, and character images on the intermediate transfer body are transferred to the printing medium.

(9) Results

The adequate range of the drying time is as follows. Time t at which the residual liquid amount begins to go into the adequate area is 4 seconds and time t at which the residual liquid amount begins to go out from the adequate area is 19 seconds, and thus the adequate range has interval of 15 seconds. Here, the transfer rate of ink became 100%, and excellent image quality could be obtained in transfer images corresponding to all of the area groups of the original image data sets. Further, printing matters are obtained with their printing quality unaffected even if the cleaning unit is detached from this apparatus.

Comparative Example 1

There is used an apparatus having a configuration in which one inkjet image forming portion and one drying portion are disposed in sequence along the rotation direction of an intermediate transfer body. All the images are formed at one time without dividing the image in the image forming step of once. Using the drying device R, a blowing time is set at every 1 second between 10 to 40 seconds and a drying operation is performed. All operations except the above-described operations are performed in the same manner as in the example 1. As a result, the adequate range of the drying time is from 18 to 29 seconds, and the adequate range of 11 seconds is wide;

however, the time required to perform the drying operation is 18 seconds at the shortest and it is extremely late.

Comparative Example 2

Using the drying device Q, the blowing time is set at every 0.5 seconds between 1 to 10 seconds and the drying operation is performed. All operations except the above-described operations are performed in the same manner as in the comparative example 1. As a result, the adequate range of the drying time is from 4 to 5.5 seconds, and the shortest drying time is extremely short at 4 seconds. Therefore, it is able to cope with the speeding up; however, the adequate range of 1.5 seconds is extremely short.

Comparative Example 3

With regard to both of the drying operations 1 and 2, using the drying device R, the blowing time is set at every 1 second between 1 to 20 seconds and the drying operation is performed. All operations except the above-described operations are performed in the same manner as in the example 1.

As a result, the adequate range of the drying time is as follows. Time t at which the residual liquid amount begins to go into the adequate area is 15 seconds and time t at which the residual liquid amount begins to go out from the adequate area is 26 seconds, and thus the adequate range has interval of 11 seconds. As described above, the adequate range is wide; however, the time t at which the residual liquid amount begins to go into the adequate area is 15 seconds and is extremely slow.

Comparative Example 4

The drying devices and blowing time of the drying operations 1 and 2 are interchanged with each other, respectively. All operations except the above-described operation are performed in the same manner as in the example 2.

As a result, the adequate range of the drying time is as follows. Time t at which the residual liquid amount begins to go into the adequate area is 4 seconds and time t at which the residual liquid amount begins to go out from the adequate area is 6 seconds, and thus the adequate range has interval of 2 seconds. As described above, the shortest drying time is short and able to cope with the speeding up, however, the adequate range of 2 seconds is short.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-145754, filed Jun. 3, 2008, which is hereby incorporated by reference herein in its entirety.

What is claimed is:

1. A method of forming an image on a printing medium, comprising the steps of:

performing an image forming process including i) an image forming step of forming at least a portion of the image on an intermediate transfer body by ejecting ink from an inkjet head onto the intermediate transfer body, and ii) a drying step of drying the ink ejected from the inkjet head onto the intermediate transfer body, wherein the image forming step and the drying step are repeated a plurality of times so as to form the image on the intermediate transfer body, and wherein a drying power is the lowest and a drying time the longest during a last drying step of a plurality of drying steps; and transferring the image from the intermediate transfer body to a printing medium, wherein the image forming process is performed prior to transferring the image from the intermediate transfer body to the printing medium.

2. The method as claimed in claim 1, further comprising the steps of:

calculating a duty of the image to be formed on the intermediate transfer body for each predetermined area;

dividing an image to be formed on the predetermined area according to the duty calculated in said calculating step, for each predetermined area, into a divided image, a portion of which is formed in each iteration of the image forming step.

3. The method as claimed in claim 1, wherein in each iteration of the image forming step, a liquid containing a component that reacts with a component in the ink is ejected onto the intermediate transfer body from a liquid ejection head, before the ink is ejected from the inkjet head.

4. The method as claimed in claim 1, wherein in a first iteration of the image forming step, a liquid containing a component that reacts with a component in the ink is applied on the intermediate transfer body by a coating roller before the ink is ejected from the inkjet head.

5. An image forming apparatus performing the method as claimed in claim 1.

6. An image forming apparatus comprising:

an image forming unit configured to form an image on an intermediate transfer body by ejecting ink onto the intermediate transfer body from an inkjet head;

a drying unit configured to perform a drying treatment for drying the ink ejected from the inkjet head onto the intermediate transfer body;

a controller configured to control said image forming unit and said drying unit so as to perform a process where the image forming unit forms a portion of the image on the intermediate transfer body by ejecting the ink onto the intermediate transfer body, and the drying unit subsequently performs the drying treatment for drying the ink ejected from the inkjet head onto the intermediate transfer body, wherein the controller is configured to repeat the process a plurality of times so as to form the image on the intermediate transfer body; and a transferring portion for transferring the image from the intermediate transfer body to a printing medium, wherein the controller is further configured to perform the process prior to transferring the image formed on the intermediate transfer body to the printing medium, and wherein a drying power is the lowest and a drying time the longest in a last drying treatment that is performed.

7. An image forming apparatus comprising:

a plurality of sections each of which includes an image forming unit configured to form a portion of an image on a intermediate transfer body by ejecting ink onto the intermediate transfer body from an inkjet head, and a drying unit configured to dry the ink ejected onto the intermediate transfer body, wherein the image is obtained through a plurality of times of image forming and a plurality of times of drying by said plurality of sections;

a transferring portion for transferring the image, from the intermediate transfer body to a printing medium, wherein the plurality of times of image forming and the plurality of times of drying are performed prior to transferring the image from the intermediate transfer body to the printing medium, and wherein a drying power and drying time by a drying unit, of the plurality of drying units included in said plurality of sections, which performs a final drying are the lowest and the longest, respectively.

* * * * *